US012041974B2

(12) United States Patent
Benjamin et al.

(10) Patent No.: US 12,041,974 B2
(45) Date of Patent: Jul. 23, 2024

(54) SYSTEMS AND METHODS FOR TESTING ONE OR MORE SMOKING ARTICLES

(71) Applicant: Data Sciences International Inc., St. Paul, MN (US)

(72) Inventors: Aaron Benjamin, Maplewood, MN (US); Justin R. Van Hee, Minneapolis, MN (US); Craig V. Aardahl, Lino Lakes, MN (US)

(73) Assignee: Data Sciences International Inc., St. Paul, MN (US)

( * ) Notice: Subject to any disclaimer, the term of this patent is extended or adjusted under 35 U.S.C. 154(b) by 628 days.

(21) Appl. No.: 17/235,044

(22) Filed: Apr. 20, 2021

(65) Prior Publication Data

US 2021/0321677 A1 Oct. 21, 2021

Related U.S. Application Data

(60) Provisional application No. 63/013,256, filed on Apr. 21, 2020.

(51) Int. Cl.
*A24F 40/80* (2020.01)
*A24F 40/40* (2020.01)

(52) U.S. Cl.
CPC ..... *A24F 40/80* (2020.01); *A24F 40/40* (2020.01)

(58) Field of Classification Search
CPC ..... A24F 40/80; A24F 40/40; A61M 15/0086; A24C 5/34
See application file for complete search history.

(56) References Cited

U.S. PATENT DOCUMENTS

| | | | | |
|---|---|---|---|---|
| 3,693,410 | A | 9/1972 | Robrecht et al. | |
| 4,019,366 | A | 4/1977 | Claflin et al. | |
| 4,140,003 | A | 2/1979 | Pillsbury et al. | |
| 4,184,360 | A | 1/1980 | Vadnay et al. | |
| 4,362,047 | A | 12/1982 | Vonreis et al. | |
| 5,113,689 | A | 5/1992 | Piade et al. | |
| 6,161,551 | A | 12/2000 | Sakuma et al. | |
| 6,698,436 | B1 | 3/2004 | Covitz et al. | |
| 9,943,388 | B2 * | 4/2018 | Cole | A61D 7/04 |
| 10,869,496 | B2 * | 12/2020 | Ademe | A24B 3/187 |
| 2008/0257368 | A1 | 10/2008 | Wilson et al. | |

(Continued)

FOREIGN PATENT DOCUMENTS

| | | |
|---|---|---|
| CN | 102155539 | 8/2011 |
| CN | 104266877 | 1/2015 |

(Continued)

OTHER PUBLICATIONS

[No Author Listed], "Orbit 20: 20 Channel Rotary Smoking Machine," Cerulean: a coesia company, 2021, 2 pages.

(Continued)

*Primary Examiner* — Hae Moon Hyeon
(74) *Attorney, Agent, or Firm* — Fish & Richardson P.C.

(57) ABSTRACT

This specification generally discloses a system and method configured to generate vapor samples from one or more smoking articles used for testing purposes. The system may be configured in a manner that reduces the likelihood of exposing particular mechanical components to the smoking article vapor, which may in turn reduce effects of fouling or corroding such components of the system over a period time.

20 Claims, 22 Drawing Sheets

(56) References Cited

U.S. PATENT DOCUMENTS

| | | | | |
|---|---|---|---|---|
| 2016/0113321 | A1 | 4/2016 | Verbeeck et al. | |
| 2017/0000082 | A1 | 1/2017 | Cole | |
| 2019/0262114 | A1* | 8/2019 | Friedman | A61B 5/097 |
| 2020/0068944 | A1 | 3/2020 | Ademe | |
| 2023/0263968 | A1* | 8/2023 | Benjamin | A61M 15/0086<br>128/204.22 |

FOREIGN PATENT DOCUMENTS

| | | |
|---|---|---|
| CN | 103674761 | 1/2017 |
| GB | 2431003 | 4/2007 |
| GB | 2517947 | 3/2015 |
| JP | 2013025431 | 2/2013 |
| WO | WO 2013/060479 | 5/2013 |
| WO | WO 2016/041347 | 3/2016 |
| WO | WO 2017/141018 | 8/2017 |
| WO | WO 2019/016094 | 1/2019 |

OTHER PUBLICATIONS

[No Author Listed], "Routine Analytical Cigarette-Smoking Machine Specifications, Definitions and Standard Conditions," Coresta Recommended Method N° 22, Aug. 1991, 16 pages.

International Search Report and Written Opinion in International Appln. No. PCT/US 21/28098, dated Aug. 5, 2021, 9 pages.

International Preliminary Report on Patentability in International Appln. No. PCT/US2021/028098, mailed on Nov. 3, 2022, 7 pages.

* cited by examiner

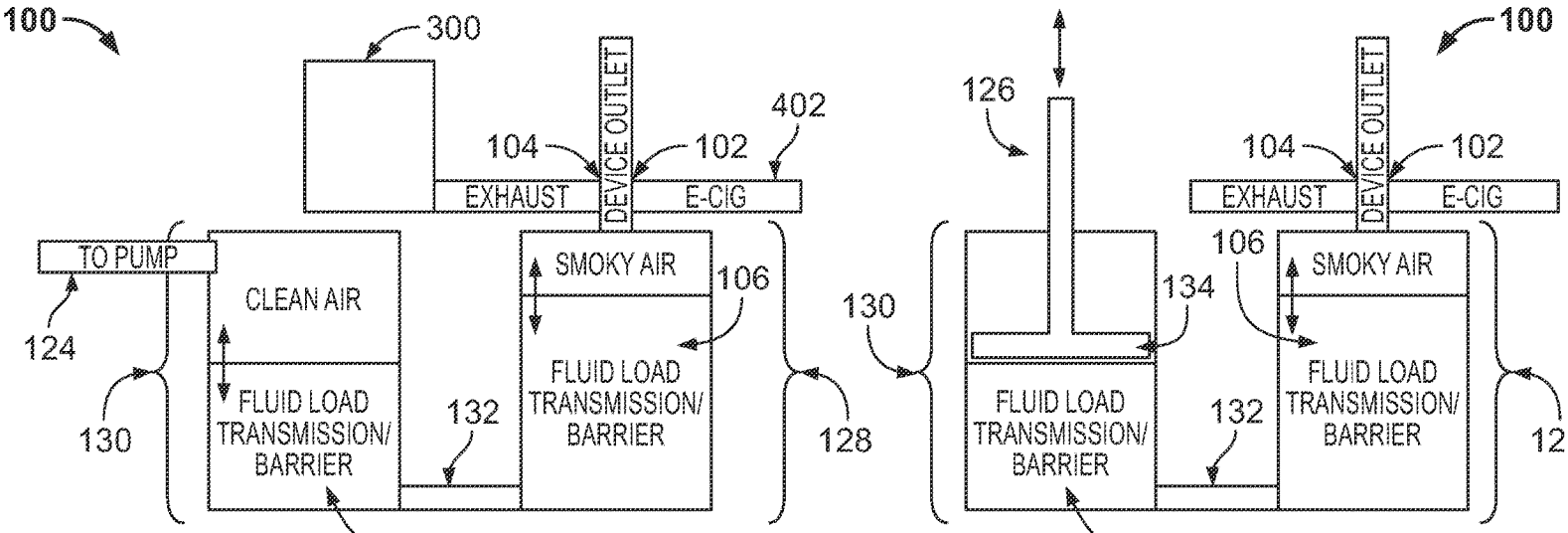
FIG. 4A
FIG. 4B
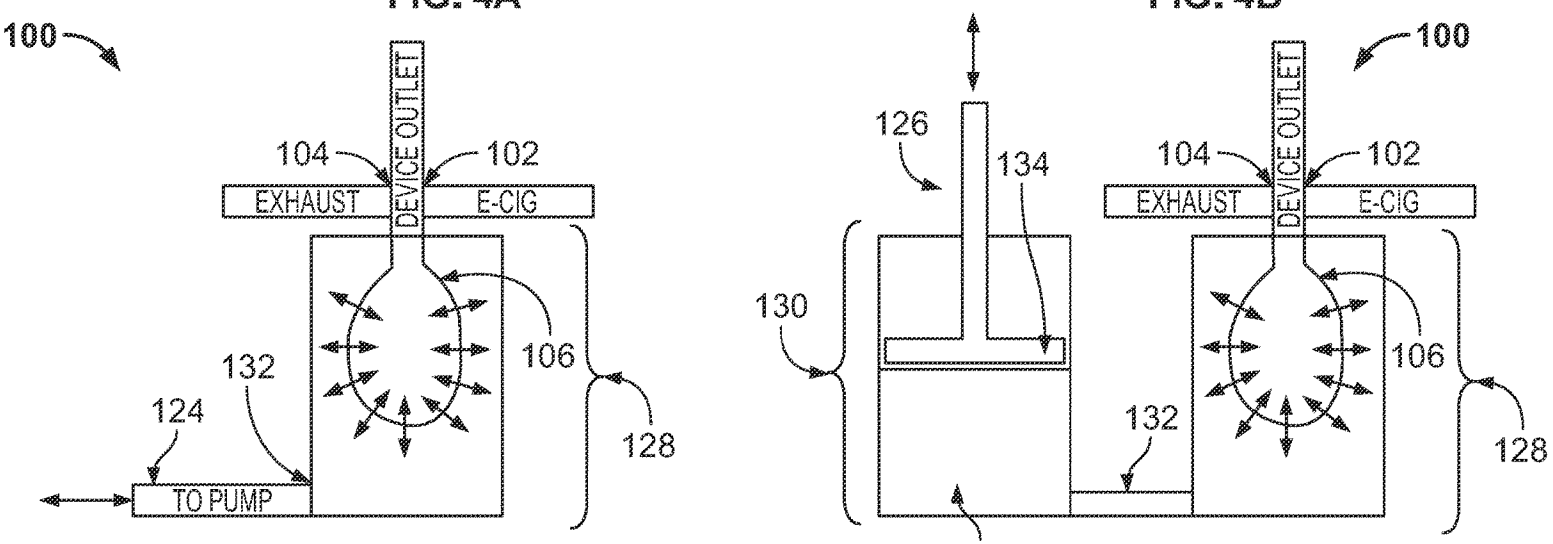
FIG. 4C
FIG. 4D

SYSTEMS AND METHODS FOR TESTING ONE OR MORE SMOKING ARTICLES

CROSS-REFERENCE TO RELATED APPLICATIONS

This application claims the benefit of U.S. Provisional Application Ser. No. 63/013,256, filed Apr. 21, 2020. The disclosure of the prior application is considered part of (and is incorporated by reference in) the disclosure of this application.

TECHNICAL FIELD

This document generally describes systems and methods used to test smoking articles, including for example, an inhalation exposure system that generates a sample smoke quantity from a smoking article and delivers the sample smoke quantity to a live test subject for inhalation.

BACKGROUND

Inhalation exposure systems (e.g., smoke/vape generators) may be used in laboratory or other testing environments for purposes of generating samples from at least one smoking article (e.g., cigarette, tobacco product, e-cigarette, nicotine, or tetrahydrocannabinol (THC) vapor product) and then delivering those samples generated from the smoking article to a designated chamber for testing or measurement. The components of the inhalation exposure system (e.g., smoke/vape generator, exposure apparatus) that are exposed to the smoke generated from the smoking articles over a period of time may be subject to fouling, corrosion, or a reduction in peak performance. For example, some inhalation exposure systems include sensitive or expensive components, such as a pump or a piston assembly to draw or push smoke from the smoking article, and at least a portion of the generated smoke may proceed in a flow path that enters the pump or the piston, thereby fouling or corroding walls, seals, and mechanical components of the inhalation exposure system.

SUMMARY

This document generally describes a system and method configured to generate vapor samples from one or more smoking articles (e.g., cigarette, tobacco product, e-cigarette, or nicotine vapor product), in which such vapor sample may optionally be used for testing purposes. The system can be configured in a manner that reduces the likelihood of exposing particular mechanical components to the smoking article vapor, which may in turn reduce effects of fouling or corroding such components of the system over a period time. The system can also be configured in a manner that reduces the likelihood of contaminating output from a smoking article by output from one or more previous smoking articles. In some optional embodiments described here, the system may operate as an inhalation exposure system that directs each smoking article vapor sample in a first flow path toward a first side of a barrier (which is movably adjustable from a first condition to a second condition) that is positioned to protect particular components of the inhalation exposure system from exposure to the smoking article vapor. Each smoking article vapor sample then may be directed in a second flow path toward a designated test chamber (away from the barrier) when the barrier is movably adjusted back to the first condition. In some configurations, the barrier is a compliant barrier, for example comprising a bellows structure, installed along the flow path of the inhalation exposure system at a position selected to protect at least a pump component, a piston assembly, electromechanical components (e.g., pressure transducers), other sensitive mechanical equipment, or a combination thereof from the smoking article vapor generated by the smoking article(s) being tested during use of the system. Optionally, the barrier may be a removable barrier (e.g., mechanically configured to easy removed and replace by a user), such as a single-use barrier that is discarded and replaced as part of scheduled maintenance of the system or as a means to prevent cross contamination between different vapor compositions. In particular implementations described herein, the inhalation exposure system may be configured to deliver the smoking article vapor to a designated chamber where at least one live subject (e.g., mice, rats, or other air-breathing animal) is exposed to at least one inhalation dose, and the live subject may be monitored over a period of time. Alternatively, the inhalation exposure system may be configured for use without a live subject, and instead the smoking article vapor may be delivered to the designated chamber where at least one sensor is positioned to measure a characteristic of the sample. In a further alternative, the inhalation exposure system may be configured for use with a live subject in the designated chamber (for exposure to at least one inhalation dose) while at least one sensor is also contemporaneously exposed to the smoking article vapor for purposes of measuring a characteristic of the sample. Alternatively, the inhalation exposure system may be configured for use with a live cell culture.

In some implementations, the barrier can be implemented as a compliant structure that includes a fluid barrier, a flexible diaphragm, a sack (e.g., comprising an elastomer, plastic, another compliant material, or a combination thereof), or a bellows structure (e.g., concentric convoluted bellow, spiral convoluted bellow, origami bellow, or the like). In some examples described below, the bellows structure can be positioned between a smoking article vapor and a pump, a piston assembly, or a mechanical actuator of the system such that smoking article vapor from the test article is isolated from such components, thereby reducing the likelihood of fouling or corroding those components and reducing the maintenance requirements of the system. Additionally, this configuration can be implemented to reduce the likelihood of contaminating subsequent smoking article vapor when switching between one or more test articles (e.g., experimenting first with an e-cigarette and then experimenting with a tobacco cigarette). In some implementations, a negative pressure can be generated behind the barrier, thereby urging the barrier to deflect in a first manner and draw in smoking article vapor through an input port in communication with the smoking article. Subsequently, the system can optionally apply a positive pressure behind the barrier, thereby urging the barrier to deflect in an opposite manner to thereby expel the smoking article vapor through an output port leading to the testing/measurement chamber.

In one implementation, an innovative aspect of the subject matter described in this specification can be embodied in systems for generating vapor samples from at least one smoking article. The system can include a mount having at least one smoking article port configured to receive at least one smoking article; a rigid reservoir and a compliant barrier mounted in the rigid reservoir, wherein the rigid reservoir has a first valve and a second valve and is coupled to the mount so that the smoking article port is in fluid communication with a first interior space of rigid reservoir on a smoke exposure side of the compliant barrier; and a pressure generator in fluid communication with a second interior space of the rigid reservoir on a second side of the complaint barrier opposite of the smoke exposure side so as to apply a positive or negative pressure within the interior space of the rigid reservoir on the second side of the complaint barrier, wherein the pressure generator is configured to apply negative pressure within the second interior space that urges the compliant barrier to deflect toward the second interior space and receive, along the smoke exposure side of the compliant barrier, a smoking article vapor from the at least one smoking article.

In a second implementation, methods transfer a smoking article vapor through an inhalation exposure system. The methods can comprise: applying negative pressure to a compliant barrier mounted within a rigid reservoir of an inhalation exposure system so that the compliant barrier is deflected; responsive to the compliant barrier being deflected, receiving, along on a smoke exposure side of the compliant barrier, a smoking article vapor from a first flow path extending from at least one smoking article port having a smoking article mounted therein; and after receiving said smoking article vapor along on the smoke exposure side of the compliant barrier, oppositely deflecting the compliant barrier so that the smoking article vapor along on the smoke exposure side of the compliant barrier is at least partially expelled away from the rigid reservoir through a second flow path that is different from the first flow path.

Some or all of the implementations can include some, all, or none of the following features. The at least one smoking article port is in fluid communication with the first interior space of the rigid reservoir along the smoke exposure side of the compliant barrier via a first flow path that includes the first valve. The at least one smoking article port is configured to receive at least one smoking article that includes an electronic cigarette or a cigarette. The pressure generator is further configured to apply positive pressure to the compliant barrier that urges the compliant barrier to deflect toward the first interior space and expel the smoking article vapor via a second flow path that includes the second valve. The pressure generator comprises at least one of a piston attached to a linear actuator and a pump. A test chamber can be in fluid communication with the second flow path extending from the second valve and configured to receive the smoking article vapor expelled from the first interior space along the smoke exposure side of the compliant barrier. The rigid reservoir includes a plurality of compliant barriers removably mounted within the rigid reservoir. The compliant barrier is removably mounted within the rigid reservoir. A second compliant barrier can replace the compliant barrier removably mounted within the rigid reservoir. The compliant barrier includes at least one of a fluid barrier, a diaphragm, a sack, and a bellow. The compliant barrier includes at least one of a concentric convoluted bellow, spiral convoluted bellow, and origami bellow. Oppositely deflecting the compliant barrier includes applying positive pressure to a first side of the compliant barrier to which the negative pressure was previously applied. Expelling the smoking article vapor through the second flow path via an output valve. Expelling the smoking article vapor into a test chamber in fluid communication with the second flow path. Applying the negative pressure to a plurality of compliant barriers removably mounted within the rigid reservoir.

One or more of the embodiments described herein can optionally provide some or all of the following advantages. First, some versions of the system described herein can advantageously provide simplified cleaning and maintenance of components, including some expensive or sensitive mechanical components, which may beneficially reduce labor and cost associated with the maintenance of the system. Second, some embodiments of the system can advantageously employ a removable barrier, which may be readily removed and replaced by a user in a simplified maintenance procedure that may eliminate or reduce burdens of cleaning components of the system. Third, some embodiments of the system described herein can advantageously control the quantity of each smoking article vapor sample in a predictable and repeatable manner, for example, where the barrier is arranged along the flow path to prevent ambient and/or residual air from seeping into the smoking article vapor sample prior to delivery into the one or more testing/measurement chambers. Fourth, some embodiments of the system described herein can advantageously reduce or eliminate contamination from one smoking article to another, advantageously increasing accuracy and/or reducing invalid test-runs. Fifth, parameters of the test environment such as temperature, humidity, etc. can be controlled, advantageously increasing accuracy and/or reducing invalid test-runs. As such, the system can be configured in a manner that achieves more accurate and consistent results over a period of repeated the smoking article vapor samples generated from one or more smoking articles.

The details of one or more embodiments are set forth in the accompanying drawings and the description below. Other features and advantages will be apparent from the description and drawings, and from the claims.

BRIEF DESCRIPTION OF DRAWINGS

FIGS. 4A-D depict diagrams of optional flows paths of a smoking article vapor sample in any of the embodiments of FIGS. 1A-G, 2A-C, and 3A-C.

DETAILED DESCRIPTION

Figure 1A:
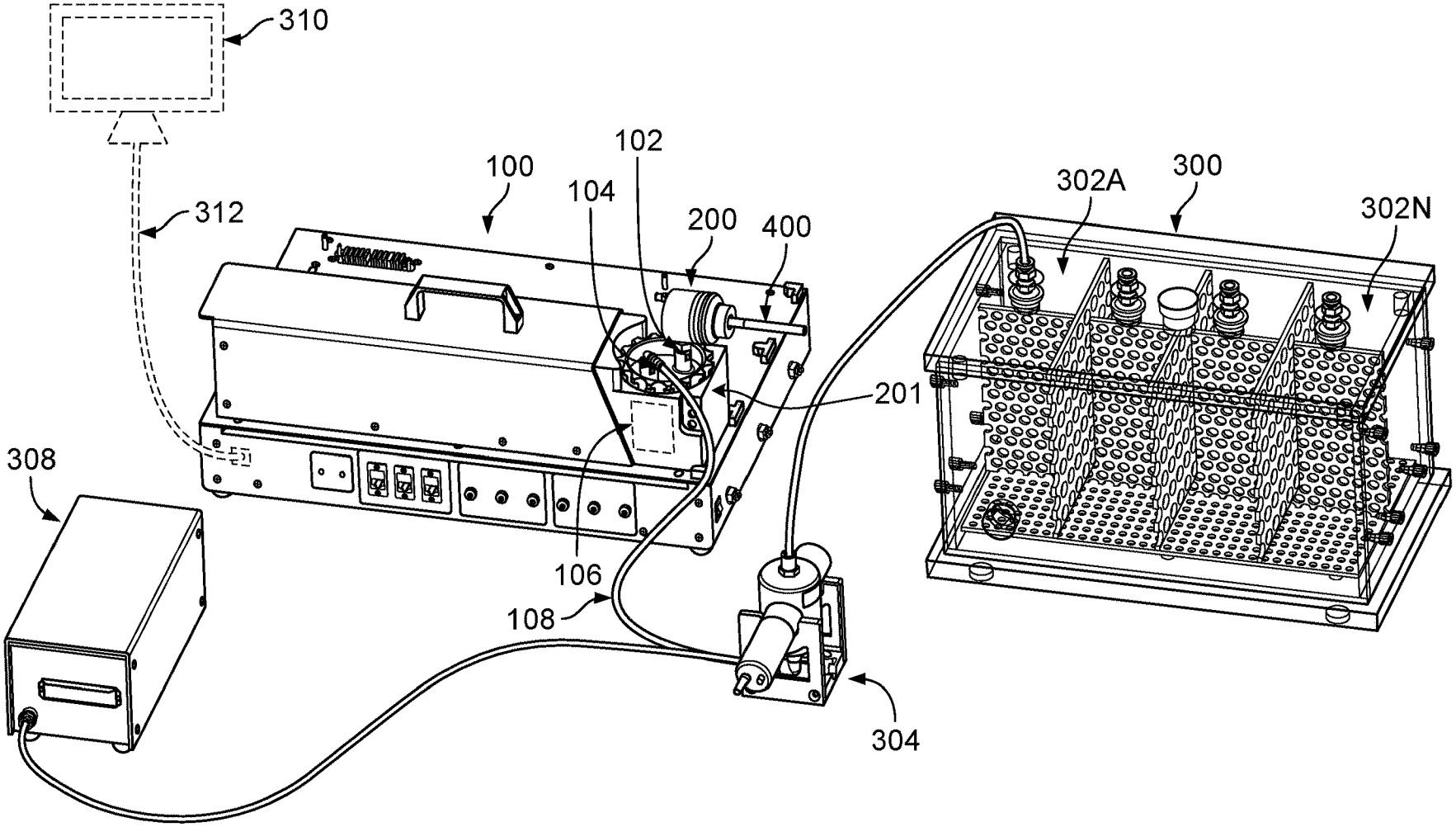
FIGS. 1A-G depict perspective views of exemplary configurations of an inhalation exposure system, in accordance with particular embodiments.

Referring to FIGS. 1A-G, some configurations of a system for generating vapor samples from at least one smoking article may be equipped with animal exposure attachments, which are used to deliver a smoking article vapor to at least one live subject (e.g., mice, rats, or other air-breathing animal) for at least one inhalation dose. For example, FIG. 1A depicts the inhalation exposure system 100 (e.g., smoke/vape generator) configured to a mass dosing chamber 300 for testing on at least one live subject. In some implementations, each section 302A-N in the mass dosing chamber 300 can house a live subject. As demonstrated in FIG. 1A, a cigarette 400 is attached to a cigarette smoking article port 200 of a mount 201. The smoking article port 200 is configured to an input valve 102 of the inhalation exposure system 100. As the cigarette 400 is puffed (e.g., smoked), a smoking article vapor travels through the input valve 102 (e.g., port, inhale valve) and into the inhalation exposure system 100. As described in more detail below, the system 100 depicted throughout FIGS. 1A-G may include a barrier 106 positioned along the flow path of the smoking article vapor (e.g., from the input valve 102 and out through an output valve 104 in the depicted example) so as to provide some protection to components of the system 100, such as a piston assembly or a pump. This configuration is advantageous such that it can reduce the likelihood of corrosion or another type of fouling to mechanical components of the system 100 that might otherwise be detrimentally affected by exposure to smoking article vapors over an extended period of time.

Referring now to the example in FIG. 1A, after the smoking article vapor flows through the interior space along the barrier 106, it may travel through the output valve 104 (e.g., port, exhale valve) and be delivered to any one of several types of outputs. As depicted in FIG. 1A, the system 100 may be configured to deliver the smoking article vapor to a designated chamber (e.g., the mass dosing chamber 300) where at least one live subject (e.g., mice, rats, or other air-breathing animal) is exposed to at least one inhalation dose, and the live subject may be monitored over a period of time. Alternatively, the inhalation exposure system 100 may be configured for use without a live subject, and instead the smoking article vapor may be delivered to the designated chamber where at least one sensor is positioned to measure a characteristic of the sample (refer to FIGS. 1D-G). In a further alternative, the inhalation exposure system 100 may be configured for use with a live subject in the designated chamber (for exposure to exposed to at least one inhalation dose) while at least one sensor is also contemporaneously exposed to the smoking article vapor for purposes of measuring a characteristic of the sample (refer to FIGS. 1F-G). Exemplary outputs can include a multi-well cell exposure tray or any known module(s) for petri dishes, suspension cells, well-inserts, power chambers, etc.

As in the example of FIG. 1A, the smoking article vapor flows through the output valve 104 and into a tube 108 that is configured to a photometer 304. The smoking article vapor then travels through the photometer 304 and into one or more sections 302A-N of the mass dosing chamber 300. Alternatively, the photometer 304 can be removed and the smoking article vapor can flow directly from the output valve 104 and into one or more sections 302A-N of the mass dosing chamber 300. The photometer 304 can be beneficial for collecting additional data/information on the tested smoking article 400. For example, the photometer 304 can measure particle concentrations of the smoking article vapor in real-time.

Figure 1B:
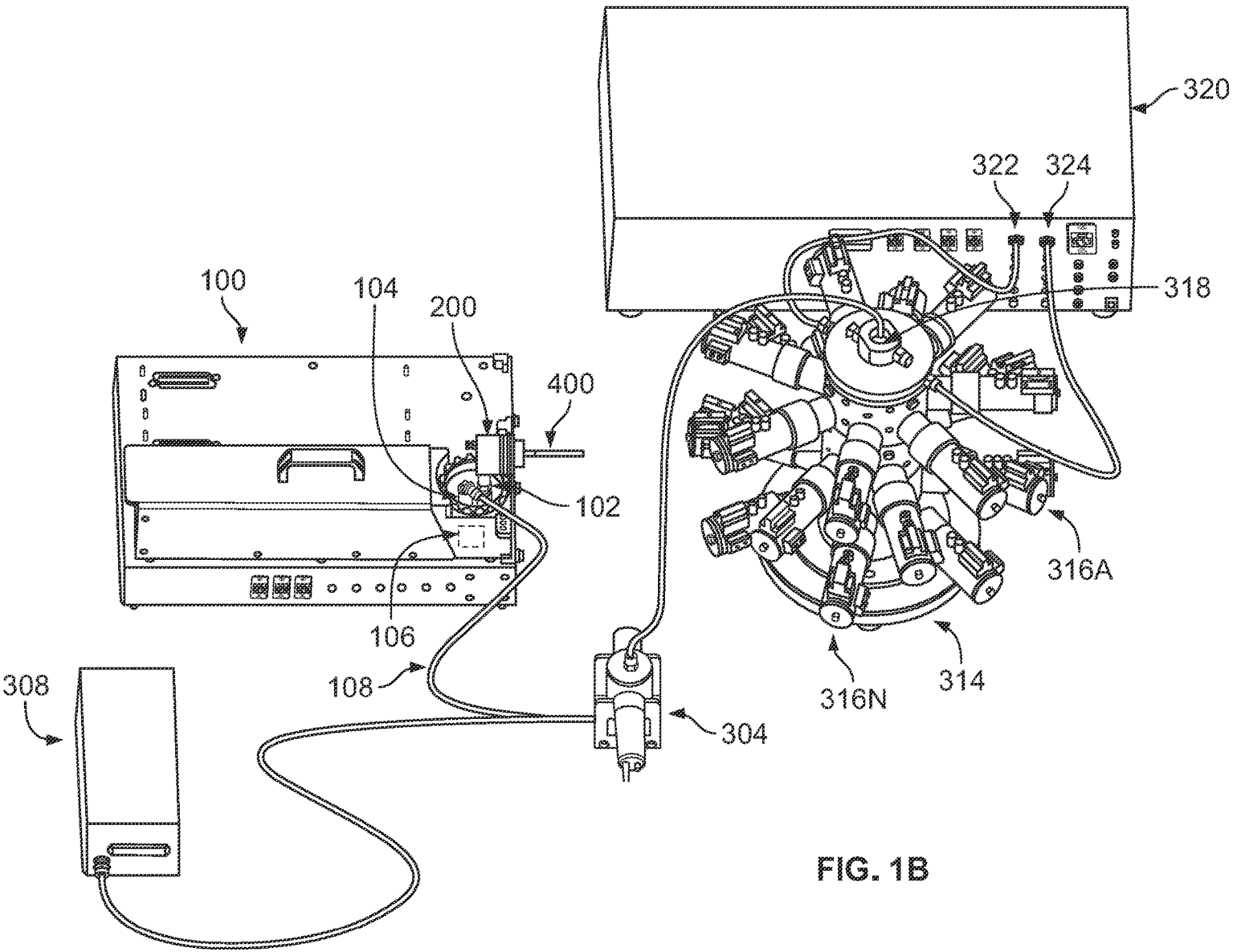
Figure 1C:
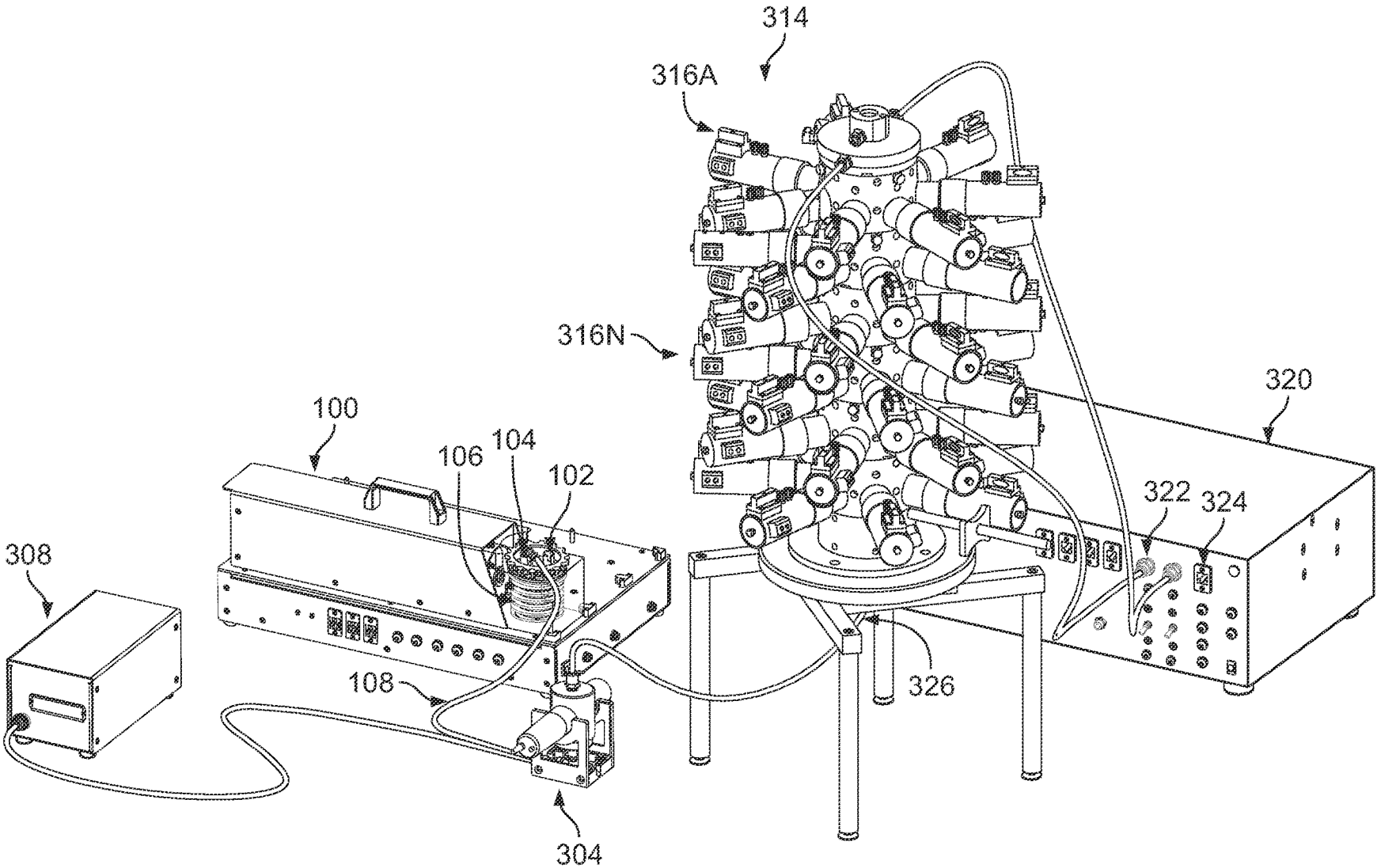
Figure 1D:
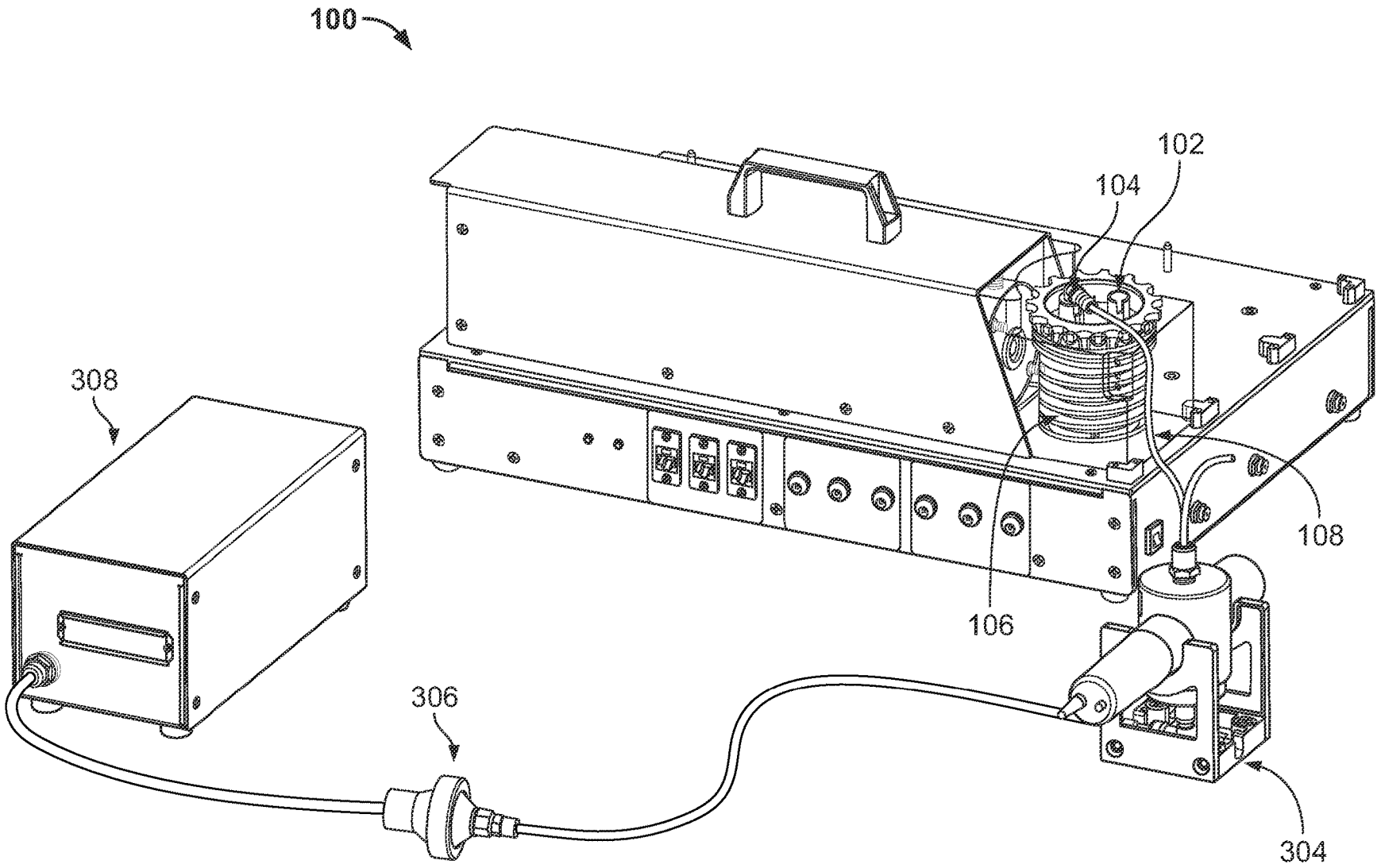
Figure 1E:
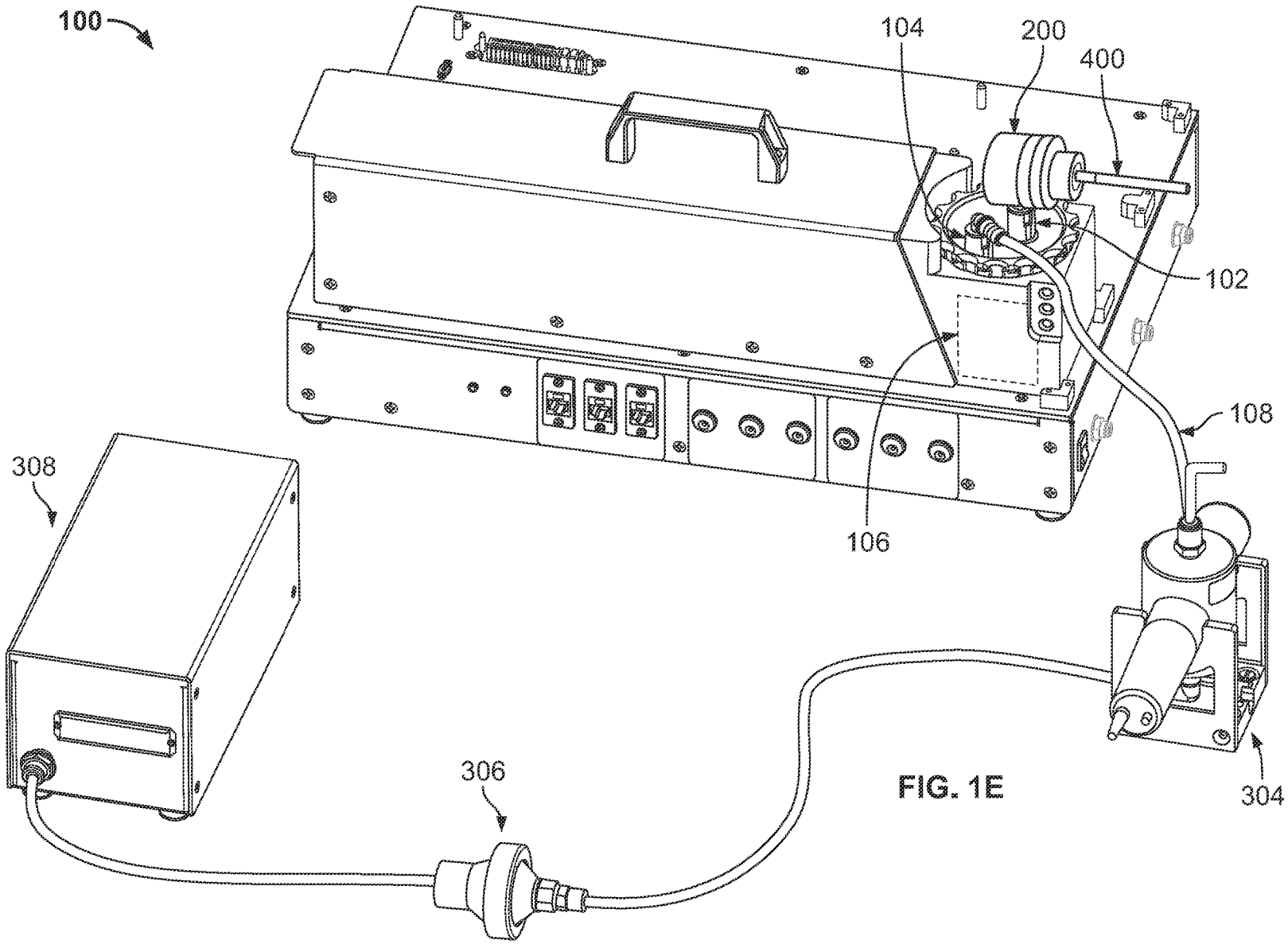

In some implementations, the smoking article vapor can also flow through a filter 306 (refer to FIG. 1D-E). Thus, the filter 306 can be attached along any one of the tubes (e.g., the tube 108) that transmits the smoking article vapor between the inhalation exposure system 100 and the mass dosing chamber 300 or other output. The filter 306 can be used in conjunction with the photometer 304. Alternatively, the filter 306 can be used without the photometer 304. The filter 306 can also be replaced with a cell culture for a cytotoxicity study.

Still referring to FIG. 1A, a supplemental flow unit 308 is connected to the photometer 304. The supplemental flow unit 308 can pump ambient air to a desired location (e.g., the photometer 304). In some implementations, the supplemental flow unit 308 can pump clean air through the photometer 304 and to the mass dosing chamber 300 to remove potential byproducts of respiration by one or more live subjects located therein and/or dilute an aerosol concentration of the smoking article vapor from the inhalation exposure system 100. Additionally, pumping ambient air from the supplemental flow unit 308 to the photometer 304 can reduce and prevent fouling of the photometer 304, The supplemental flow unit 308's direction of flow can be dependent on a desired configuration of a user. The inhalation exposure system 100 depicted herein can additionally include a power source/generator, such as a battery (not depicted). The inhalation exposure system 100 can be in communication (e.g., wired, by a USB 312, for example, and/or wireless) with a user device 310, including but not limited to a computer, tablet, phone, etc. A user can control the inhalation exposure system 100 from the user device 310, view information/data received from the inhalation exposure system 100 in real-time, and/or modify settings of the system 100 while it is in operation. For example, at the user device 310, the user can monitor each section 302A-N of the mass dosing chamber 300 that receives a flow of the smoking article vapor from the inhalation exposure system 100 (refer to FIGS. 8A-B).

FIG. 1B depicts the inhalation exposure system 100 configured to a tower 314 of individual animal chambers 316A-N. As demonstrated, the cigarette 400 is attached to the smoking article port 200. As the cigarette 400 is puffed, the smoking article vapor enters the inhalation exposure system 100. As described in more detail below, the smoking article vapor can flow through interior space along the barrier 106 before being expelled through the output valve 104 so as to reduce potential fouling, corrosion, or other damage to mechanical components of the system 100. Once through the output valve 104, the smoking article vapor can flow through the tube 108 and the photometer 304, and into an inflow valve 318 at a top surface of the tower 314. The smoking article vapor can then be distributed (e.g., equally distributed, unequally distributed by biasing to one chamber over another) to one or more chambers 316A-N (e.g., plethysmography sites) in the tower 314.

The tower 314 can retain live subjects (e.g., rats, mice), wherein each live subject is exposed to at least one inhalation dose. Chambers 316A-N that receive the smoking article vapor can be coupled to an inhalation tower controller 320. The inhalation tower controller 320 can receive the smoking article vapor through an input valve 322 from the tower 314 and measure certain conditions of that vapor before outputting the vapor through an output valve 324 and back into the tower 314. The inhalation tower controller 320 can optionally measure and/or control a tower pressure, flow, temperature, humidity, plethysmograph transducers, and photometer inputs. FIG. 1C depicts another view of the inhalation exposure system 100 coupled to the tower 314. This exemplary view depicts the inhalation exposure system 100 without a smoking article port coupled to the input valve 102. Additionally, the tower 314 is elevated off a surface/ground. When the inhalation exposure system 100 is in use and a smoking article vapor is generated, the smoking article vapor goes through the photometer 304 described herein and travels up through an inflow valve 326 at an underside of the tower 314. The components of this configuration perform as described herein.

FIGS. 1D-E depict the inhalation exposure system 100 as an in-vitro configuration with the filter 306. In the example of FIG. 1D, the input valve 102 of the inhalation exposure system 100 does not receive a smoking article port. In the example of FIG. 1E, the smoking article 400 (e.g., cigarette) is attached to the smoking article port 200 (refer to FIG. 3A), which is configured to the input valve 102. In both examples of FIGS. 1D-E, the filter 306 is an in-line filter. The filter 306 can be used for gravimetric analysis, gravimetric calibration of a photometer, and/or particle composition analysis. To work for a gravimetric calibration of the photometer, the filter may be placed downstream of the photometer. This can be done to take a tare weight of the filter and catch particulate during a run while recording photometer data. A re-weigh of the filter can provide the mass of particulate produced by the machine. Dividing this value by known flow and run time will give an average concentration (e.g., Mass/Volume.) Comparison of this value to the average output recorded on the photometer will let you apply a correction factor to the photometer data.

For a chemical analysis or in-vitro cellular analysis, the filter could be placed anywhere in the flow path downstream of the test. An example includes a filter being placed between the smoke generator and the test article to e.g., minimize the effect of material loss. If any photometer data had to be collected in conjunction with a particle composition analysis, the filter may be placed, e.g., downstream of the photometer.

In some situations, it may be advantageous to route the vape to multiple cell exposure sites, which may involve either routing the flow over a multi-well plate or routing and splitting flow through a manifold to multiple isolated sites. The filter 306 described herein can optionally be replaced with a cell culture for a cytotoxicity analysis.

Figure 1F:
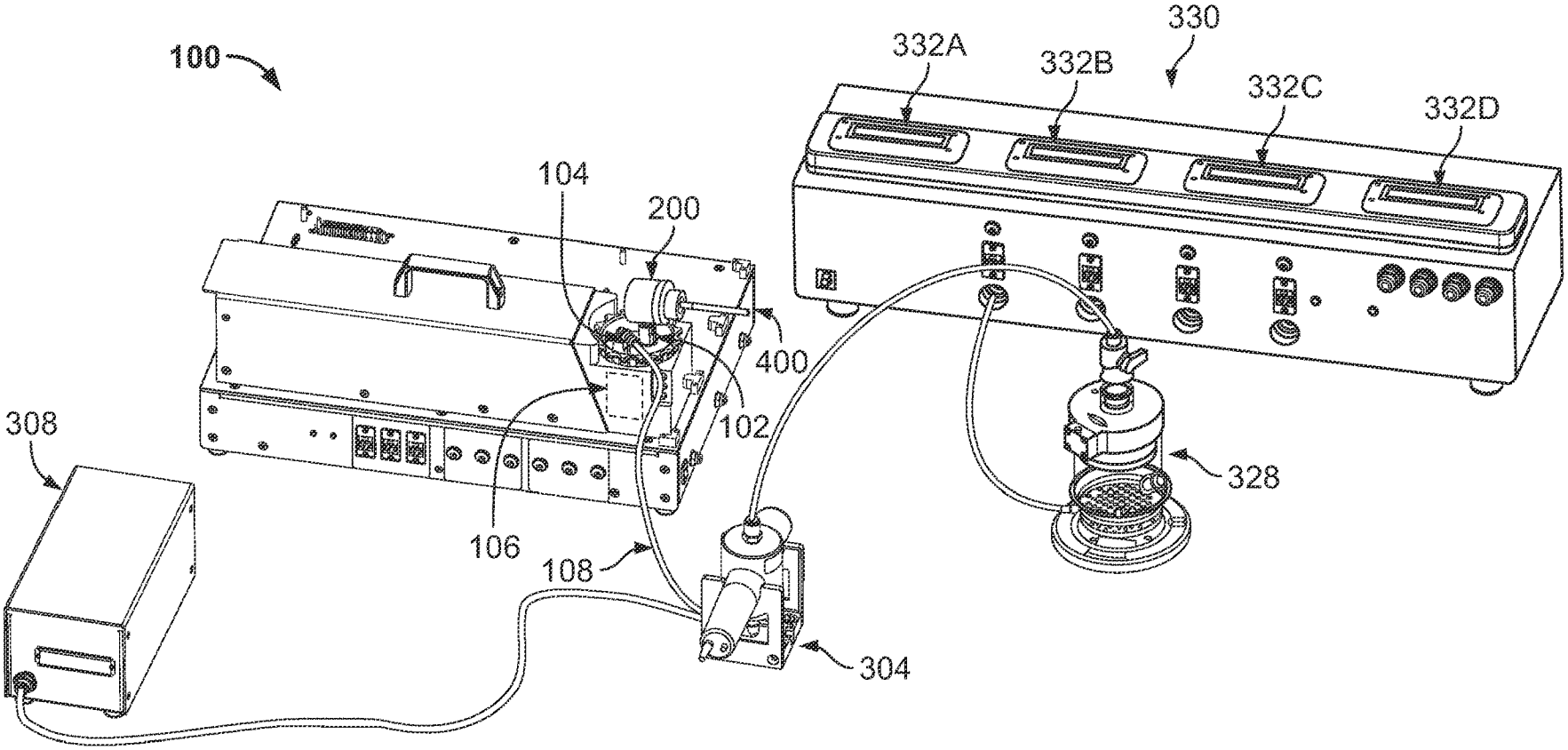
Figure 1G:
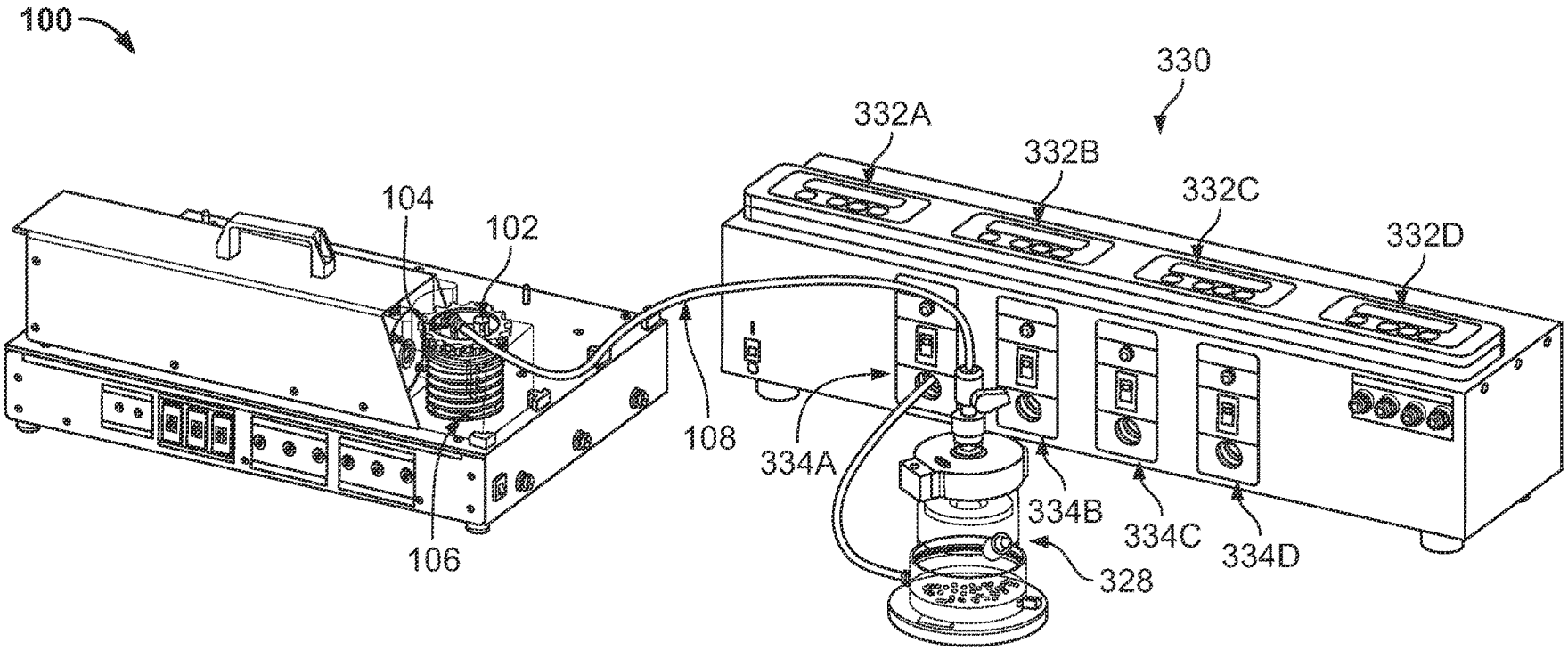

FIGS. 1F-G depict the inhalation exposure system 100 configured to a plethysmography chamber 328. The system 100 described herein can use negative pressure to pull air into the plethysmography chamber 328 and out into the ambient air. Alternatively, a negative bias flow can be used to pull air into the plethysmography chamber 328 from ambient air using a negative pressure pump and a separate controller. In some implementations, the in-line filter 306, as depicted in FIGS. 1D-E, can optionally be placed between the negative pressure pump and the plethysmography chamber 328 such that the filter 306 can collect aerosol and other particles that a live subject (e.g., animal, lab rat) does not inhale inside the plethysmography chamber 328.

FIG. 1F depicts the photometer 304 described herein coupled with the plethysmography chamber 328 and the inhalation exposure system 100. Additionally, the smoking article 400 is attached to the smoking article port 200, which is further coupled to the input valve 102 of the inhalation exposure system 100. FIG. 1G, alternatively, depicts the plethysmography chamber 328 in direct connection with the output valve 104 of the inhalation exposure system 100.

In both FIGS. 1F-G, the plethysmography chamber 328 is connected to a plethysmography control system 330. This system 330 can be in communication (e.g., wired and/or wireless) with a computer and/or the user device 310 (refer to FIG. 1A). The user, therefore, can monitor and view information regarding plethysmography analysis in real-time. The user can also adjust/modify properties of the plethysmography analysis. The control system 330 depicted includes four sites 332A-D that can be connected to four plethysmography chambers. In alternative embodiments, the control system 330 can have fewer or more sites. Each site 332A-D on the control system 330 includes respective sets 334A-D of input and output valves that can be used for nebulizer, transducer, and bias flow. A bias flow port (bottom of the 334A-D grouping) may be a pneumatic port only. The top port can emit a high frequency electric pulse to power a piezoelectric mesh nebulizer. The received analog signal may be received from the pressure transducer and a temperature/humidity probe if attached.

The exemplary configurations depicted in FIGS. 1A-G can be combined. For example, the tower 314 of FIGS. 1B-C can be configured with the plethysmography chamber 328 of FIG. 1F. Similarly, the filter 306 in FIGS. 1D-E can be configured to any one of the configurations depicted and described throughout this disclosure.

Figure 2A:
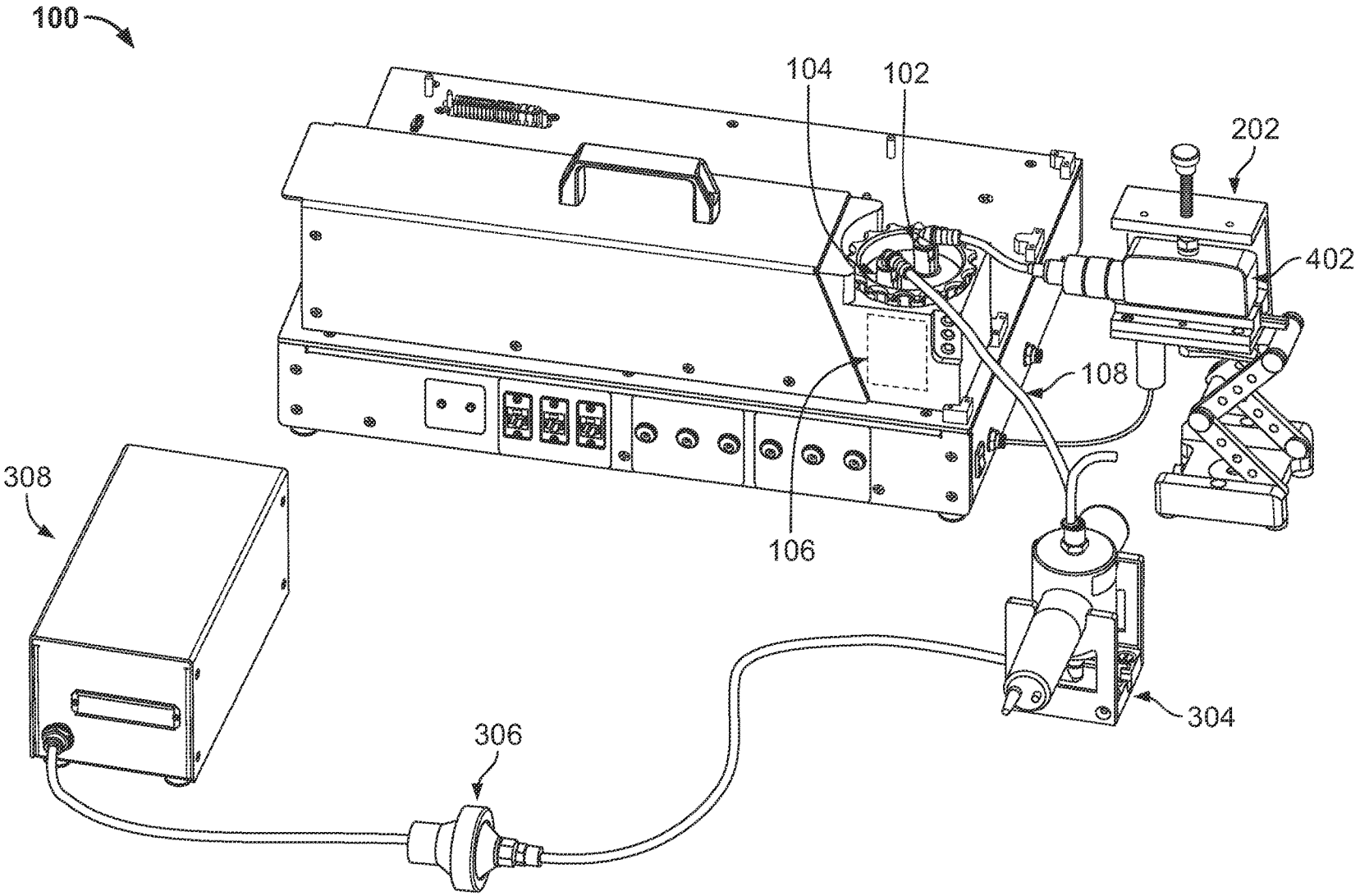
FIGS. 2A-C depict perspective views of exemplary configurations of an inhalation exposure system, in accordance with further embodiments.
Figure 2B:
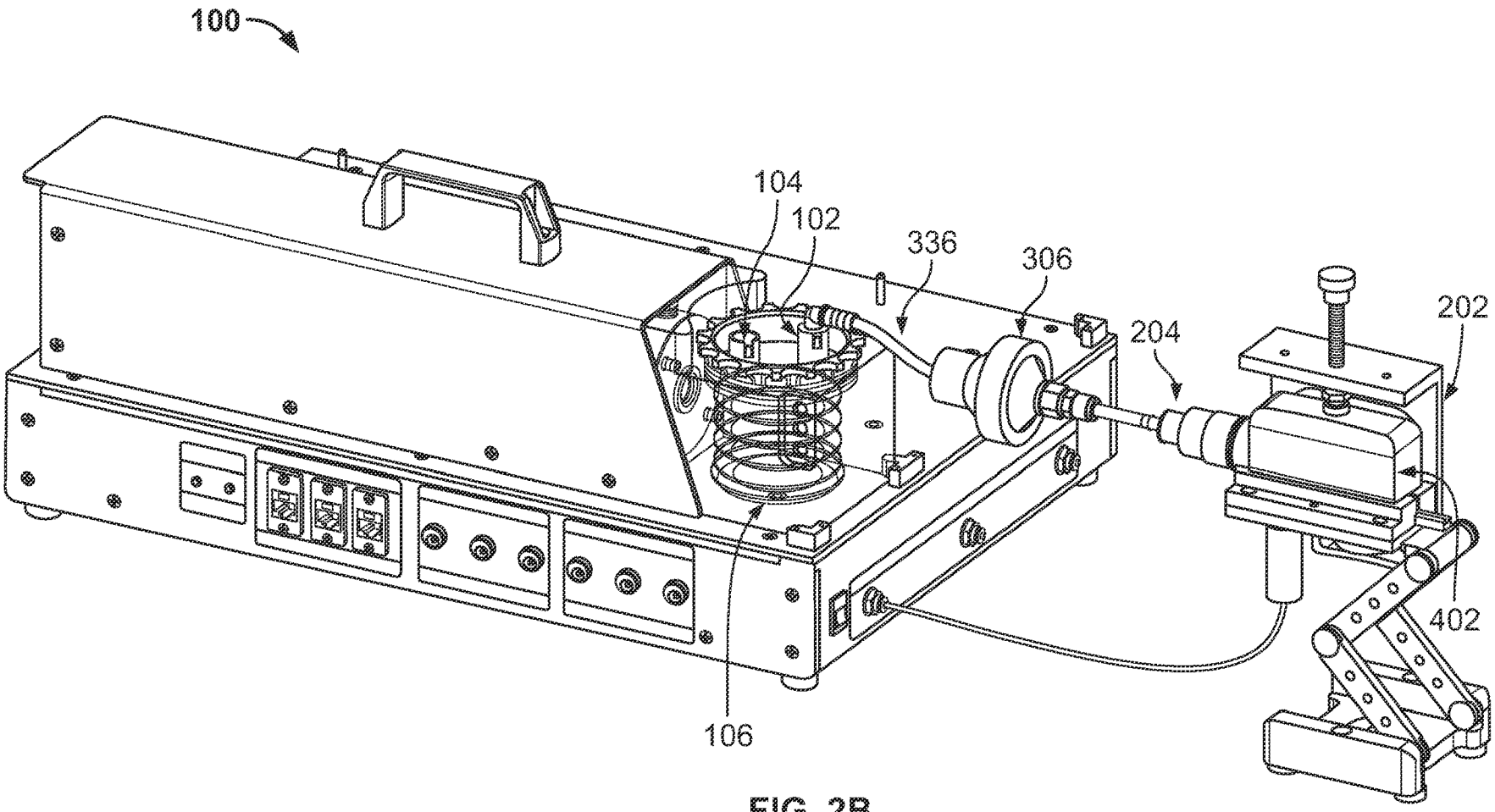
Figure 2C:
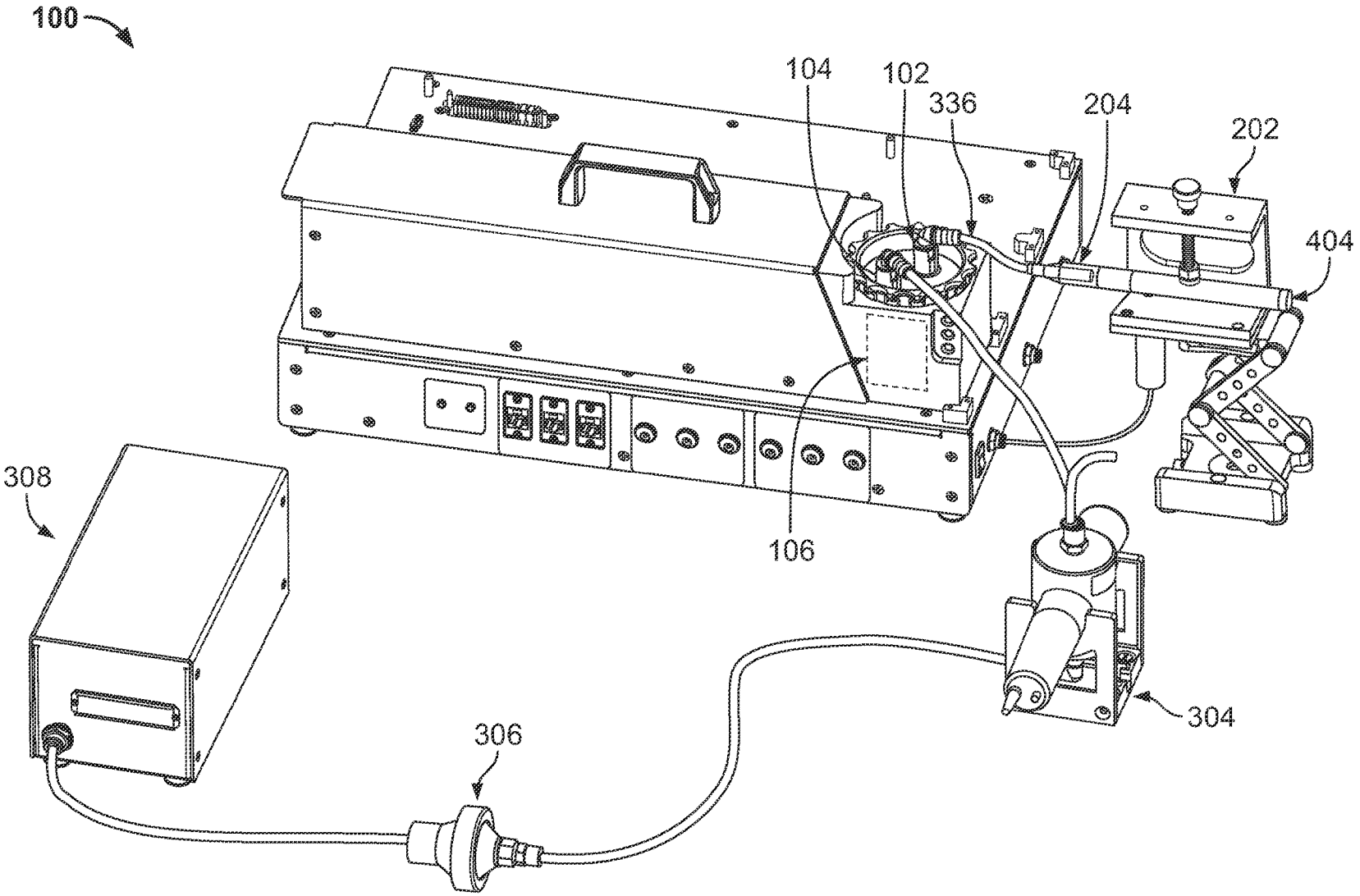

Referring now to FIGS. 2A-C, some configurations of the system 100 described throughout may be equipped to receive (and subsequently test) e-cigarette. FIG. 2A depicts the inhalation exposure system 100 configured to an e-cigarette mod 402 via a tilt platform 202. This configuration further includes the photometer 304 and the filter 306 as previously described, or may optionally include other optical sensors (e.g., optical particle counters, laser particle counters, condensation particle counters) and electrical sensors (scanning electrical mobility spectrometers, differential mobility analyzers). In this example, the filter 306 can be used for chemical composition analysis. FIG. 2B depicts an alternative configuration of the inhalation exposure system 100 with the e-cigarette mod 402 and the filter 306, wherein the filter 306 is placed along a tube 336 between the input valve 102 of the inhalation exposure system 100 and a smoking port 204 for the e-cigarette 402. This configuration is advantageous to measure a chemical composition of air immediately after it is vaped. FIG. 2C depicts the inhalation exposure system 100 configured to an e-cigarette pen 404 via the tilt platform 202, with the tube 336 being inserted into the input valve 102 and the smoking article port 204 to capture a smoking article vapor when generated by the system 100.

Figure 3A:
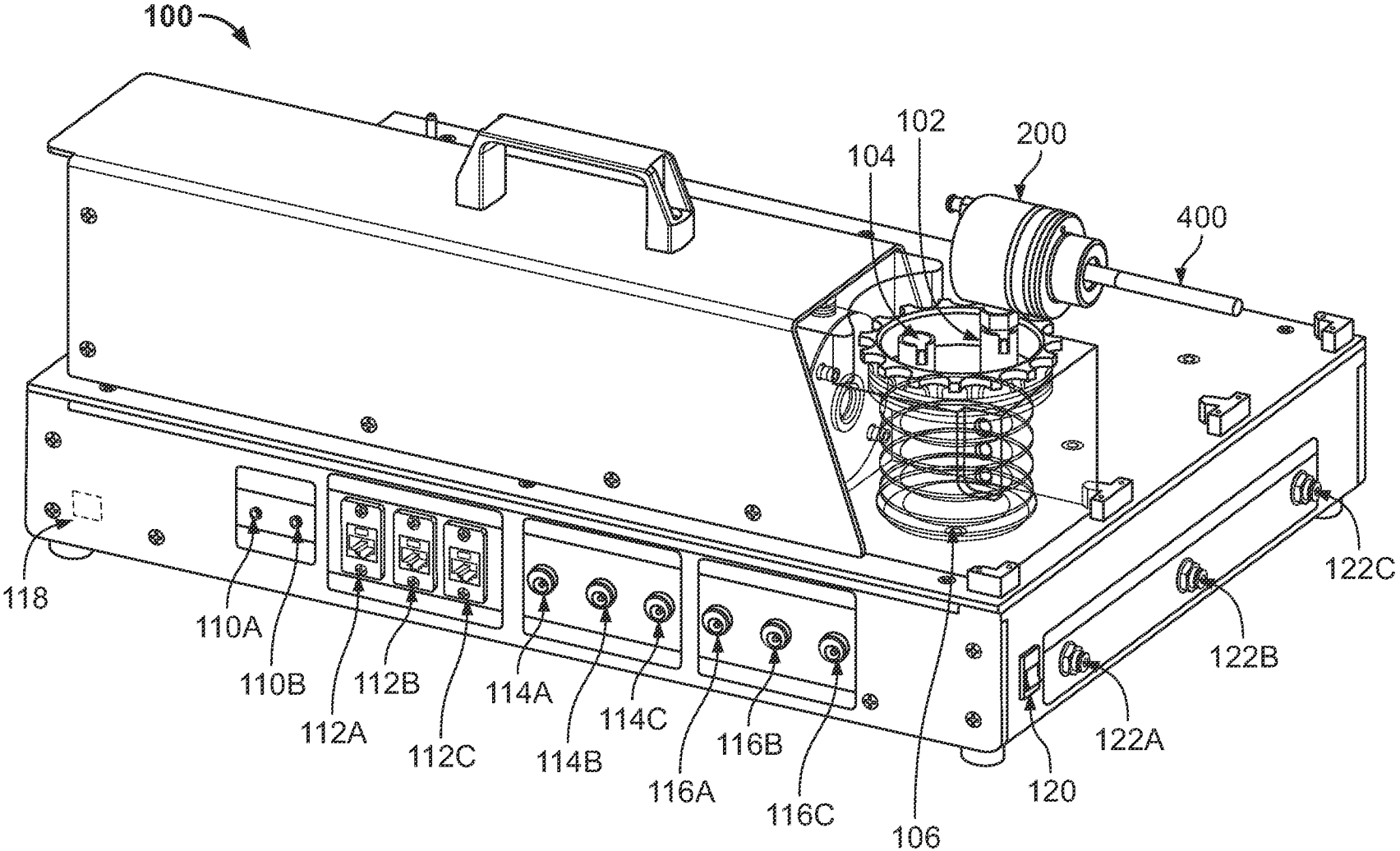
FIGS. 3A-C depict perspective views of exemplary configurations of an inhalation exposure system, in accordance with additional embodiments.
Figure 3B:
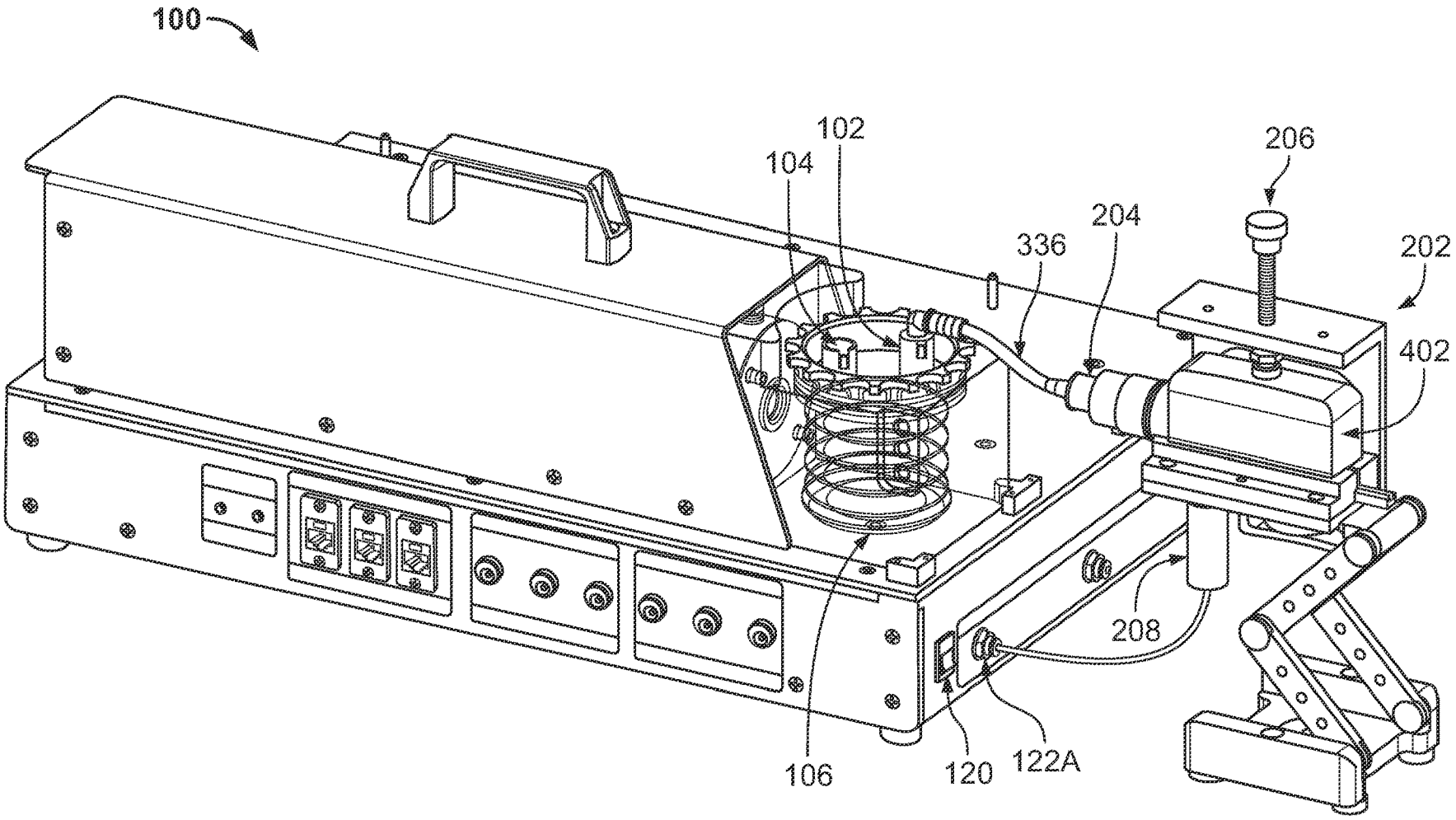
Figure 3C:
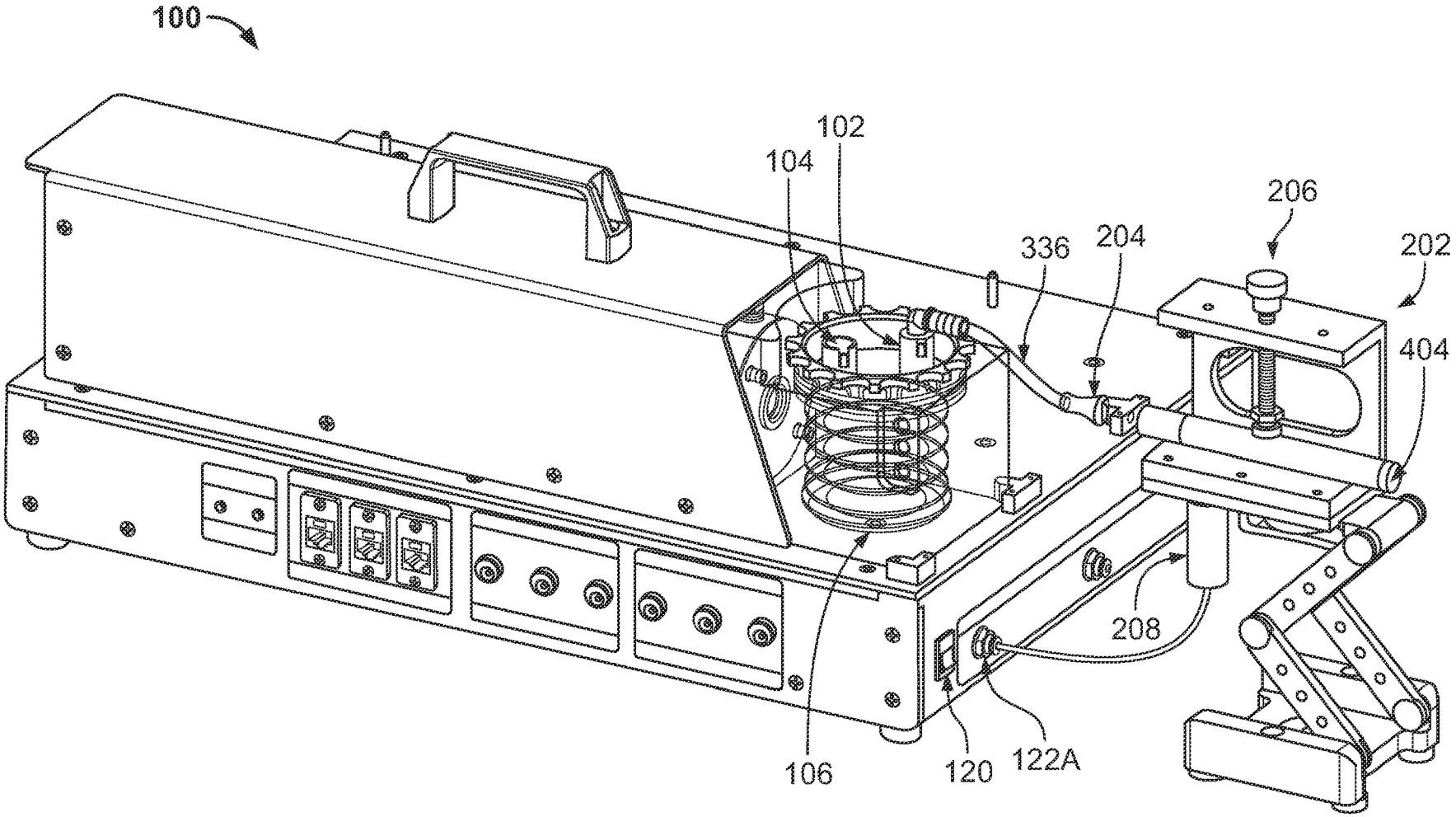

Referring now to FIGS. 3A-C, some configurations of the system 100 described throughout may be equipped with smoking article ports configured to provide for the testing of different types of smoking articles, such as cigarettes and e-cigarettes. In particular, FIG. 3A depicts the smoking article port 200 described herein (refer to FIG. 1A). This port can be advantageous for coupling the cigarette 400 (e.g., tobacco or similar traditional smoking article and a first generation e-cigarette) to the input valve 102 of the inhalation exposure system 100. The port 200 permits the capture of smoking article vapor as the cigarette 400 is smoked by the inhalation exposure system 100. The smoking article vapor is pulled in through the input valve, through the interior space along the barrier 106, as described below, and then available for testing, analysis, and/or measurement. In the example of FIG. 3A, the port 200 is a labyrinth seal, which has silicon membranes that are configured together with a foam washer. Additionally, a cover (not depicted, refer to FIGS. 6A-B) can be placed around the cigarette 400 to capture secondhand vapor. In alternative implementations (not depicted), the cigarette 400 may slide into an elbow sleeve with a silicon tube. Different smoking article ports can fit into the input valve 102 of the inhalation exposure system 100, depending on the user's testing needs and the smoking article being tested, as depicted in FIGS. 3A-C.

Alternatively, in some implementations, lateral fill rubber membranes can be employed and configured to the input valve 102. A labyrinth membrane system can also be beneficial for use with different types of smoking articles, including both traditional tobacco cigarettes and e-cigarettes. As a result, the user would not need to use different attachments for testing different types of smoking articles.

FIGS. 3B-C depict the tilt platform 202 for coupling e-cigarette mods 402, e-cigarette pens 404, and other similar types of smoking articles to the input valve 102 of the inhalation exposure system 100. The tilt platform 202 can adjust to different heights and can be adjusted based on the smoking article that is being tested. A pin 206 (e.g., screw) can be used to keep the smoking article 402 or 404 in place while smoking article vapor is generated. The pin 206 can be located at a top bracket of the tilt platform 202. The pin 206 can screw down (e.g., tighten) on a surface of the smoking article 402 or 404, thereby holding the smoking article 402 or 404 in place. As depicted, the pin 206 can be long enough so that it can adjust accordingly based on the type of smoking article that is tested. Additionally, the tilt platform 202 includes a button actuator 208 (e.g., pneumatic) that can be used to begin vaping the smoking article 402 or 404.

Furthermore, as depicted in FIGS. 3A-C, the inhalation exposure system 100 includes both input and output ports for photometers (e.g., analog input) 110A and 110B respectively, inter-integrated circuits 112A-C, pumps 114A-C, and regulation controllers 116A-C for one or more pumps. The system 100 can further include a USB port 118 for wired communication with a computer system and/or the user device 310 (refer to FIG. 1A). The system 100 can further wirelessly communicate with the computer system and/or the user device 310 (e.g., BLUETOOTH, WIFI, etc.). The inhalation exposure system 100 includes a power switch 120 and high pressure pneumatic ports 122A-C (e.g., 50-100 psi) for each smoking article that is configured to the system 100. As depicted, the high pressure pneumatic port 122A is attached to the button 208 (e.g., a piston) by a high pressure line. The port 122A-C is configured to actuate the button 208 (e.g., a piston), which in turn presses a button of the smoking article 402 or 404 to activate the smoking article 402 or 404.

In the example of FIG. 3B, the user can turn on the inhalation exposure system 100 by flipping the power switch 120. The user can then begin testing/vaping the e-cigarette mod 402 once the high pressure pneumatic port 122A actuates the button 208 that is coupled to an underside of the tilt platform 202. Once the button 208 is actuated, the e-cigarette mod 402's heating element can turn on such that the e-cigarette mod 402 can generate a smoking article vapor. The Smoking article vapor can be transmitted, via the tube 336, into the input valve 102 of the inhalation exposure system 100 for testing and analysis. As described in more detail below, the vapor can flow through the interior space along the barrier 106 so as to provide some protection of components from the smoking article vapor of the e cigarette mod 402. Alternative implementations may permit the user to start the vaping/smoking process by interacting with a user interface at the user device 310 (refer to FIG. 1A, FIGS. 8A-B). The user interface can provide the user with options to control the inhalation exposure system 100 and testing of different types of smoking articles (e.g., the cigarette 400, the e-cigarette mode 402, the e-cigarette pen 404, etc.).

Now referring to FIG. 4A, a fluid load transmission/barrier (e.g., barrier 106) and a pump 124 are configured to the inhalation exposure system described herein. The pump 124 can be a pressure source and/or generator. The pump 124 is configured to move clean air (e.g., ambient) into a first chamber 130. Within the first chamber 130, the air can cross the barrier 106, which can be hydraulic fluid and/or incompressible fluid, a non-volatile incompressible fluid, and/or water. The first chamber 130 can be connected to a smoke chamber 128 by a port 132 (e.g., a port having minimal flow restriction). The smoke chamber 128 can have additional fluid load transmission/barrier 106 like that in the first chamber 130. When pressure is applied to the first chamber 130, the port 132 can open such that the air passes through the barrier 106 of the first chamber 130 and into the smoke chamber 128, thereby causing a smoking article, for example the e-cigarette 402, that is attached to the system 100's input valve 102 to be smoked. The smoking article vapor can enter the smoke chamber 128 through the input valve 102, and based on pressure change generated by the pump 124 in the first chamber 130, output through an exhaust valve (e.g., output valve 104) and into a testing chamber, such as the mass dosing chamber 300, or a filter, cell culture, or other output as previously described. The differential pressure generation permits the opening and closing of valves 102 and 104, making each valve used in the configurations described herein one-way (e.g., check valves, pneumatic valves, electrically actuated valves, etc.). The use of one-way valves ensures that air flows in one direction to ensure accuracy of testing and analysis. The configurations depicted throughout are also advantageous because the use of the barrier 106 ensures that components of the system 100, such as the pump 124, are protected and less prone to fouling, corroding, or other damage by use of the system 100.

FIG. 4B depicts use of the fluid load transmission/barrier (e.g., barrier 106) and a piston 126 for actuating the inhalation exposure system 100. The configuration of FIG. 4B functions the same as the configuration depicted and described in FIG. 4A. Instead of the pump 124 in FIG. 4A, the configuration in FIG. 4B employs the piston 126 having a plunger 134 to apply pressure to the barrier 106 in the first chamber 130. The piston 126 can be coupled to some type of actuator (e.g., button, linear actuator), pump, and/or rotating mechanism that moves the piston 126 and the plunger 134, as described herein.

FIG. 4C depicts use of the barrier 106, wherein the barrier 106 is complaint (e.g., bellow, refer to FIGS. 1A-G, 2A-C, 3A-C), within the smoke chamber 128 (e.g., rigid reservoir). In some implementations, the smoke chamber 128 can include a plurality of compliant barriers. The barrier 106 can be removable and/or fixed in place within the smoke chamber 128. Additionally, the barrier 106 can be replaced with a new compliant barrier when the barrier 106 is fouled by smoking article vapor expelled from a smoking article (e.g., the e-cigarette mod 402). In this configuration, the pump 124, as previously described, is used to generate a change in pressure such that the barrier 106 within the smoke chamber 128 can be expanded and contracted. The pump 124 can be connected to/coupled with the smoke chamber 128 by the port 132 that exposes a side (e.g., back) of the 106. The barrier 106 can be at least one of a fluid barrier, a diaphragm, a sack, and a bellow. In some implementations, the barrier 106 can be made from rubber, plastic film, and/or another type of compliant material. In yet other implementations, the barrier 106 can be at least one of a concentric convoluted bellow, a spiral convoluted barrier, and an origami bellow. The barrier 106 can further be positioned within the smoke chamber 128 such that the input valve 102 is in fluid communication with the barrier 106.

Still referring to FIG. 4C, the pump 124 can be configured to apply negative pressure to the barrier 106, thereby causing the barrier 106 to expand and receive through the first valve 102 (e.g., input valve) smoking article vapor from a smoking article attached to a smoking article port, as previously described (refer to FIGS. 1A-G, 2A-C, 3A-C). Additionally, the pump 124 can be configured to apply a positive pressure to a side of the barrier 106, thereby causing the barrier 106 to contract and expel, through the output valve 104 in the smoke chamber 128, the vapor that was previously received in the barrier 106 from the smoking article. As previously mentioned in relation to FIG. 4A, the vapor can be expelled into a testing chamber (e.g., the mass dosing chamber 300), filter, cell culture, or other form of output discussed herein.

Referring now to FIG. 4D, the barrier 106 can be deflected within the smoke chamber 128, which can be driven by the piston 126 for actuating the system 100. The configuration of FIG. 4D functions the same as the configuration depicted and described above in FIGS. 4A-C. Like the configuration in FIG. 4B, the configuration depicted in FIG. 4D employs the piston 126 and plunger 134 for applying pressure within the first chamber 130 that is separate from the smoke chamber 128. The piston 126 can have some type of actuator (e.g., button, linear actuator, refer to FIGS. 5, 6A-B), pump, and/or rotating mechanism that makes the plunger 134 move up and down, as described herein. Use of the compliant barrier 106, as shown in FIGS. 4C-D (e.g., barrier 106) is advantageous to protect mechanical components, such as the piston 126, the plunger 134, and/or the pump 124 from fouling, corroding, or other damage from using the system 100.

Figure 5:
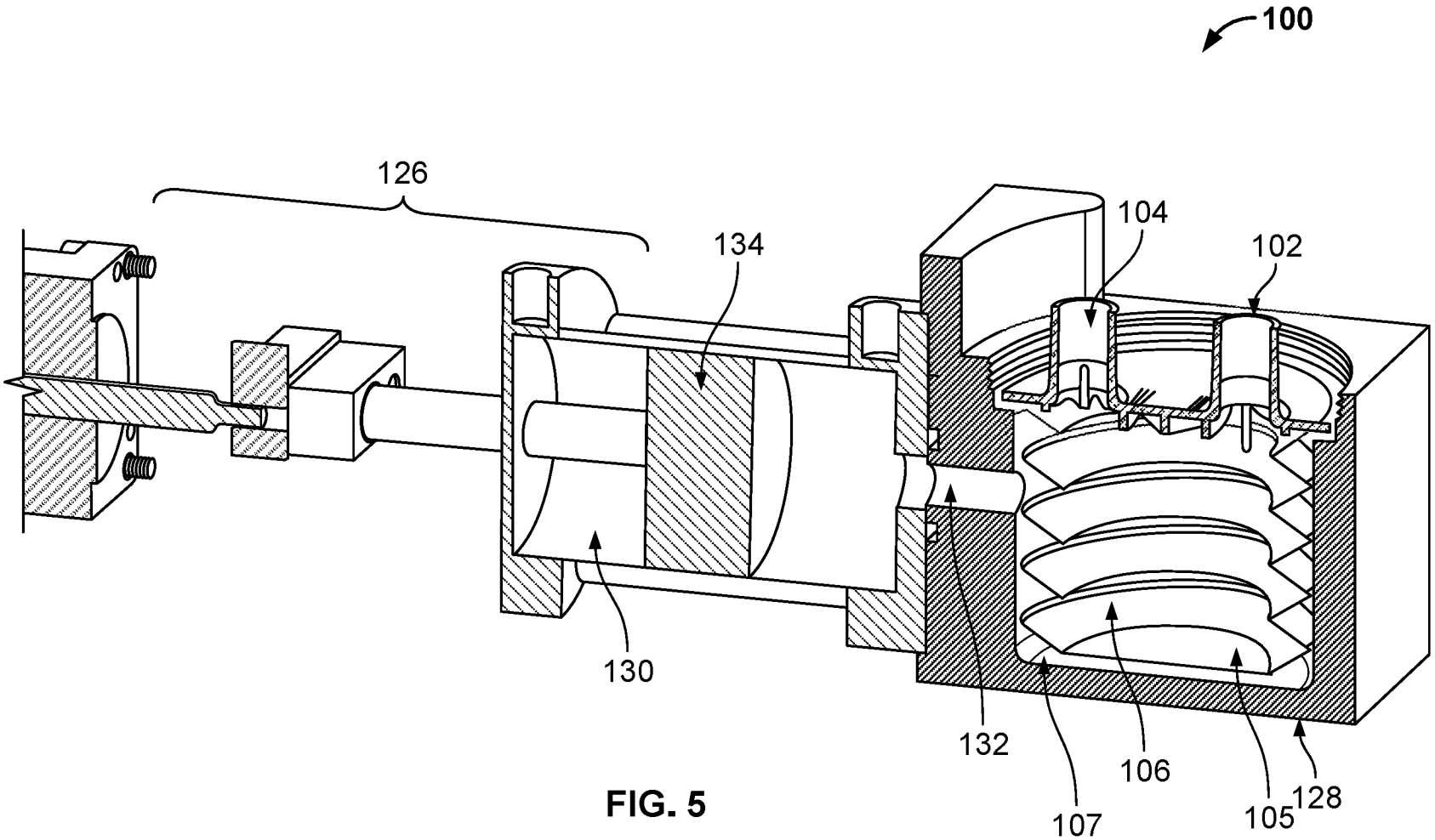
FIG. 5 depicts a perspective cross-sectional view of particular components of the inhalation exposure system from any of the embodiments of FIGS. 1A-G, 2A-C, and 3A-C.

Referring to FIG. 5, the inhalation exposure system 100 includes the piston 126. In other implementations, a pump can be used, such as a positive displacement, peristaltic, or centrifugal pump. Different types of actuators and/or pressure generators as disclosed herein and/or known in the industry can be employed. Referring to the configuration in FIG. 5, the piston 126 can act as a differential pressure generator, thereby applying negative and positive pressure to parts of the device, namely the barrier 106 within the smoke chamber 128, as disclosed. The port 132 allows for movement of air between the first chamber 130 containing a portion of the piston 126 and the plunger 134 and the smoke chamber 128 (e.g., rigid container, rigid reservoir). The smoke chamber 128 further includes at least one compliant barrier (e.g., bellow), as described herein.

When negative pressure is generated by the piston 126 negative pressure can be applied to a side of the barrier 106, thereby causing the barrier 106 to expand (e.g., toward a second interior space 107 of the smoke chamber 128). When the barrier 106 expands, it can bring smoking article vapor through the input valve 102 (e.g., one-way valve) of the smoke chamber 128 into the compliant barrier 106. Then, once positive pressure is applied to a side of the barrier 106 by the piston 126, the barrier 106 can contract (e.g., toward a first interior space 105 of the smoke chamber 128), which causes the vapor within the barrier 106 to be expelled through the output valve 104 (e.g., one-way valve). Because the valves 102 and 104 employed in the inhalation exposure system 100 are one-way valves, air/vapor can flow in a single desired direction as negative or positive pressure is generated and applied. This is advantageous because it ensures that mechanical components, such as the piston 126, are less likely to be fouled by the smoking article vapor. As a result, the user may have to clean and/or replace mechanical components less often. Alternatively, the user can remove the barrier 106 from the smoke chamber 128 and replace it with a new barrier and/or clean the compliant barrier 106 upon fouling.

Figure 6A:
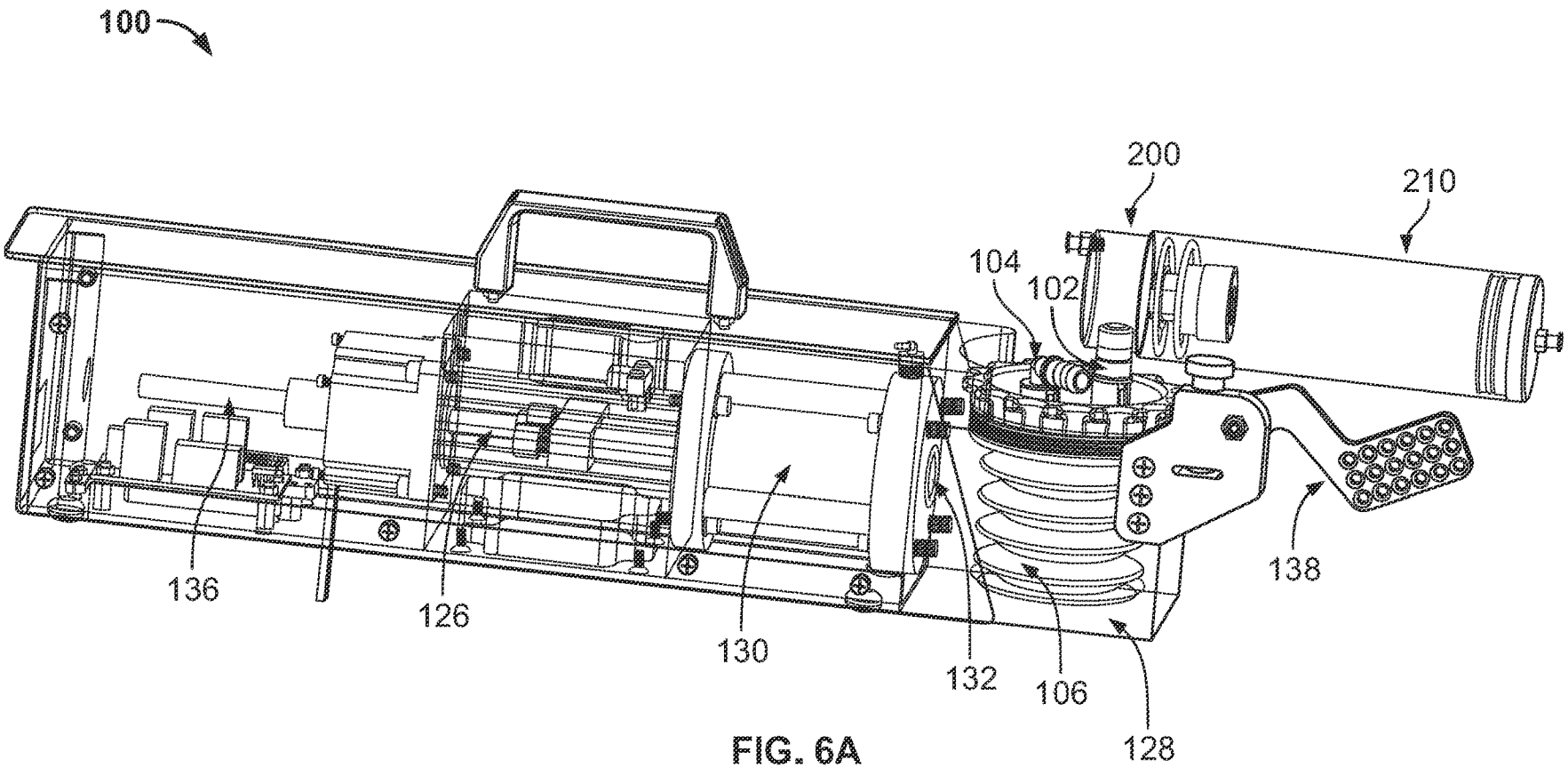
FIGS. 6A-B depict side views of the components of FIG. 5.
Figure 6B:
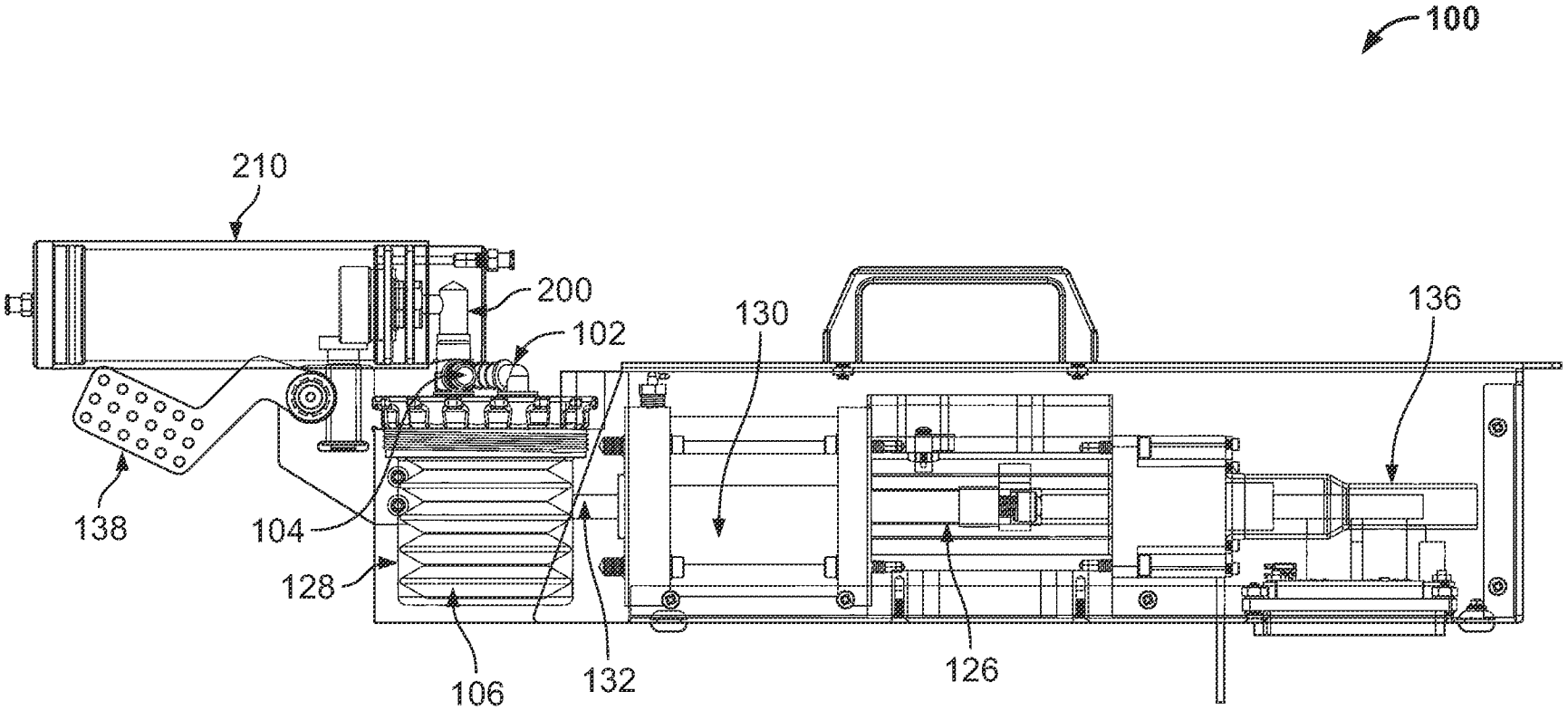
Figure 7:
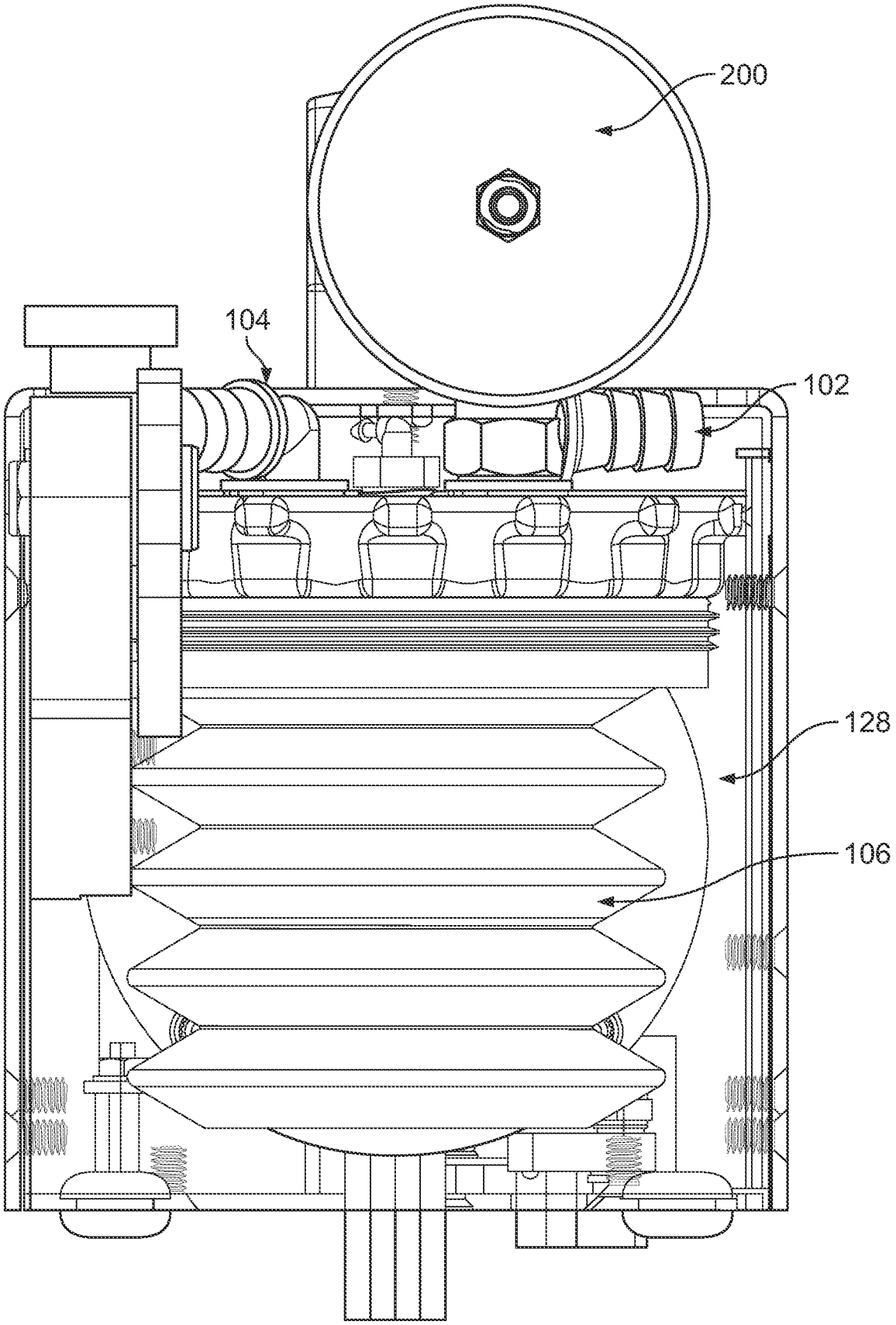
FIG. 7 depicts a front view of the components of FIG. 6B.

Referring to FIGS. 6A-B and 7, the inhalation exposure system 100 may further include a rotating mechanism 136 (e.g., actuator) that facilitates generating differential pressure by causing the attached piston 126 to move forward and back. The inhalation exposure system 100 functions according to the disclosure herein. The inhalation exposure system 100 depicted in FIGS. 6A-B additionally includes a cover 210 that is placed over/attached to the smoking article port 200. As a result, secondhand smoking article vapor can be analyzed when a smoking article is placed in the port 200 and tested. The cover 210 can be removable. The configuration depicted in FIGS. 6A-B and 7 further includes a plurality of brackets 138. The plurality of brackets 138 can be used to mount tubes, chambers (e.g., individual chambers for holding live subjects, refer to FIGS. 1A-G), and other types of outputs for testing and analysis of smoking article vapor. The brackets 138 can be made from one or more materials that provide mechanical properties to perform these functions, including but not limited to plastic or aluminum.

Figure 8A:
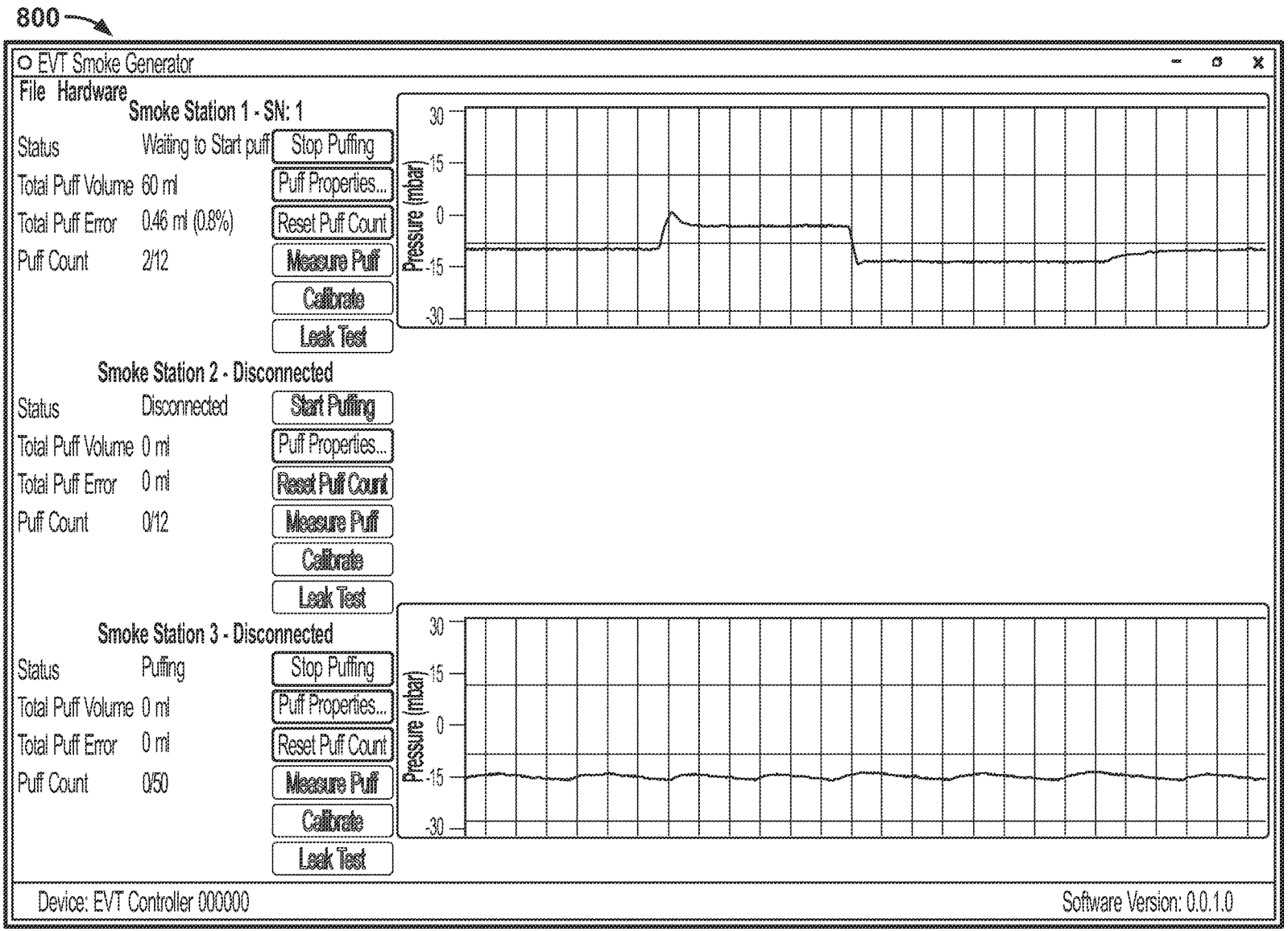
FIGS. 8A-B depict exemplary graphical user interfaces of the inhalation exposure system from any of the embodiments of FIGS. 1A-G, 2A-C, and 3A-C.
Figure 8B:
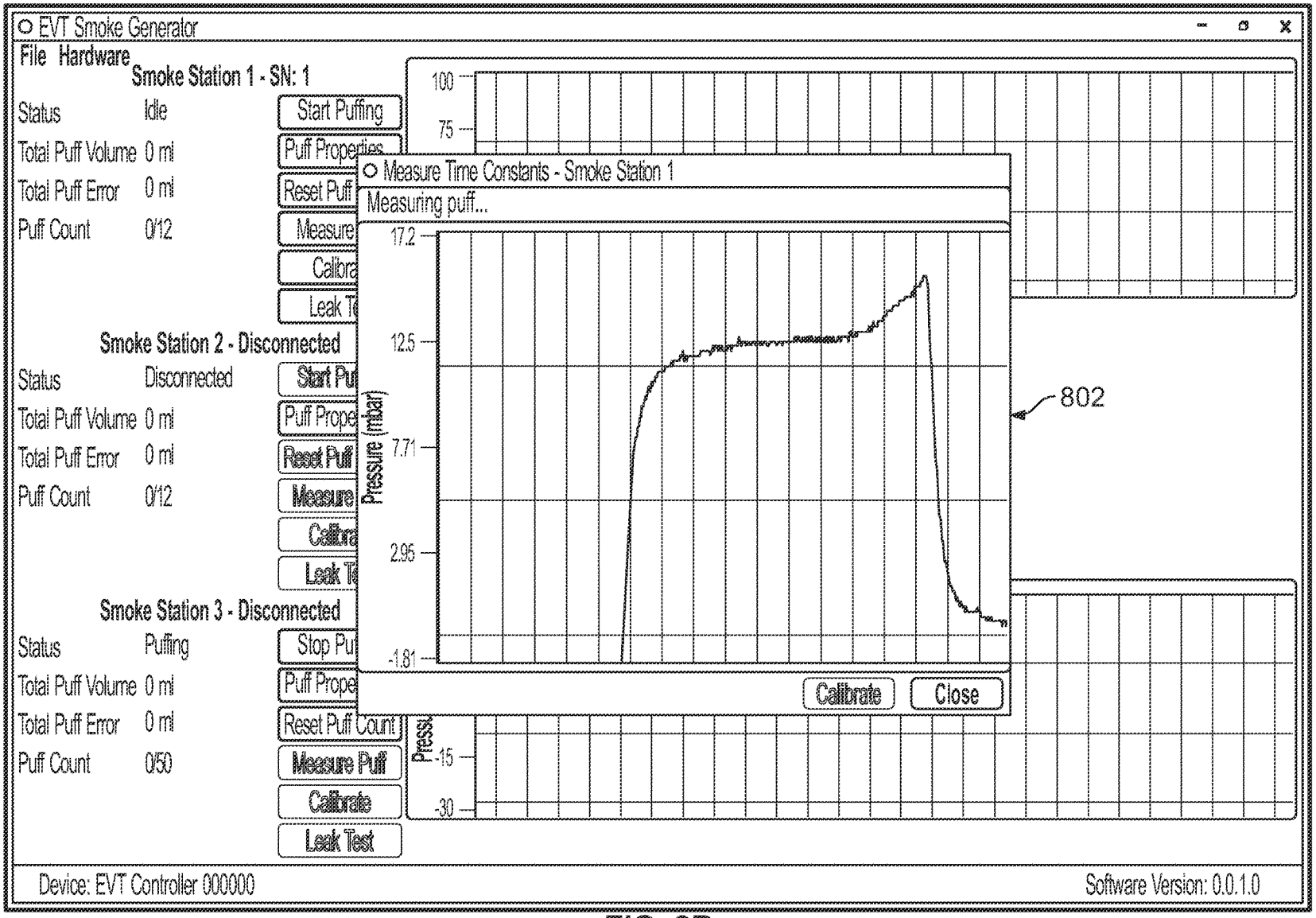

Referring now to FIGS. 8A-B, the user can control the inhalation exposure system 100 from a computer and/or the user device 310 (refer to FIG. 1A) that is in communication (e.g., wired and/or wireless) with the inhalation exposure system 100. A graphical user interface (UI) 800 can present information to the user at the user device 310. Using the UI 800, the user can select a particular station that is connected to the inhalation exposure system 100 for testing. For example, if four plethysmography chambers are connected to the inhalation exposure system 100, the user can monitor and/or modify properties associated with any one of those chambers via the UI 800. The user can select what type(s) of smoking article is used for testing. Based on that selection, a profile for each station and/or barrier (e.g., the barrier 106 described herein) can be adjusted accordingly. The adjustments to each profile can be based on user-inputted information and/or information stored by the input device 310 (e.g., presets). The user can chose to apply standard puffs and/or modify the puffs, such as changing a puff frequency and/or a puff volume. The user can also use the UI 800 to perform a leak test, which determines whether the barrier 106 was placed correctly within the smoke chamber 128 and/or whether the smoking article is correctly affixed to the smoking article port. The leak test more generally ensures that there is no leakage or air from any of the valves and components used in the inhalation exposure system 100.

Still referring to FIG. 8A, the user can select an option/press a button to start puffing (e.g., turn on/actuate the inhalation exposure system 100 and/or the differential pressure generator). The inhalation exposure system 100 can perform as many puffs as the user manually selects. Alternatively, the system 100 can perform a predetermined number of puffs based on the user's selection of the type of smoking article and/or other characteristics. The user can also couple a mass flow sensor to the inhalation exposure system 100 and use the UI 800 to view data sensed in real-time. The user can then compare mass flow volumes before and after a smoking article is tested. In some implementations, the mass flow sensor can be coupled to an end of a smoking article (e.g., a butt of a cigarette and/or e-cigarette). In other implementations, the mass flow sensor can be coupled to a tube that encompasses the smoking article (e.g., refer to FIG. 2B).

While the inhalation exposure system 100 puffs the smoking article, information can be transmitted in real-time to the user device 310. That information can be displayed at the UI 800. For example, as depicted in FIGS. 8A-B, a pressure wave forms in real-time at the UI 800 as the device puffs the smoking article. The pressure wave that is graphically depicted can be proportional to a flow through the smoking article that can be based on a resistance of the smoking article.

Referring back to FIG. 8A, the UI 800 depicts each smoke station and its associated properties and data. For example, smoke station 1 is connected to the inhalation exposure system 100 and is in communication with the user device 310. Smoke station 1 refers to a pressure measurement off the piston, which is used to actuate the inhalation exposure system 100 and generate the differential pressure, as previously described. A pressure sensor can be positioned between a head of the piston and the barrier 106 (e.g., bellow) such that real-time pressure measurements can be made and transmitted to the user device 310. Additionally, if a photometer is used (refer to FIG. 1A), particle concentrations can be monitored and collected in real-time. The photometer data can be displayed in a plot/graph like the pressure wave form depicted in FIG. 8A. Additionally, each station has a "status," "total puff volume," "total puff error," and "puff count." This information is updated in real-time as the user controls the inhalation exposure system 100 and/or the system 100 is generally actuated (e.g., puffing the smoking article). In some implementations, different information can be listed and associated with each station.

Still referring to FIG. 8A, the user has several options (e.g., buttons) with regards to controlling each smoke station independently of each other. The user can start and stop puffing, change one or more of the puff properties, reset a puff count, measure a puff, calibrate, and/or perform a leak test. Upon selecting the option/button for puff properties, the user can modify a puff volume, frequency, number of puffs, puffs per minute, inhalation properties, exhalation properties, as well as select what type of smoking article is being used (e.g., cigarette, e-cigarette, etc.). Upon selecting the option/button to measure a puff, a graph/plot like the pressure wave plot can be produced as a pop-up window 802 (refer to FIG. 8B). The new plot for measuring puff can be made using data collected in real-time from a mass flow sensor that is attached to the inhalation exposure system 100. Additional and/or alternative sensors can be used, such as a pressure sensor and/or a photometer, as described throughout this disclosure. In some implementations, temperature and/or humidity sensors can be used and coupled with a heat output. The temperature and/or humidity sensors can be configured to regulate a temperature and/or humidity of a flow path.

As mentioned, the UI 800 can also display a pressure wave (refer to FIG. 8A) for each of the smoke stations that are connected to the inhalation exposure system 100. The pressure wave can be updated in real-time. Each smoke station can be controlled independently of the other. As a result, the user can perform different tests and/or the same test but with different properties and/or conditions per stations.

Figure 9:
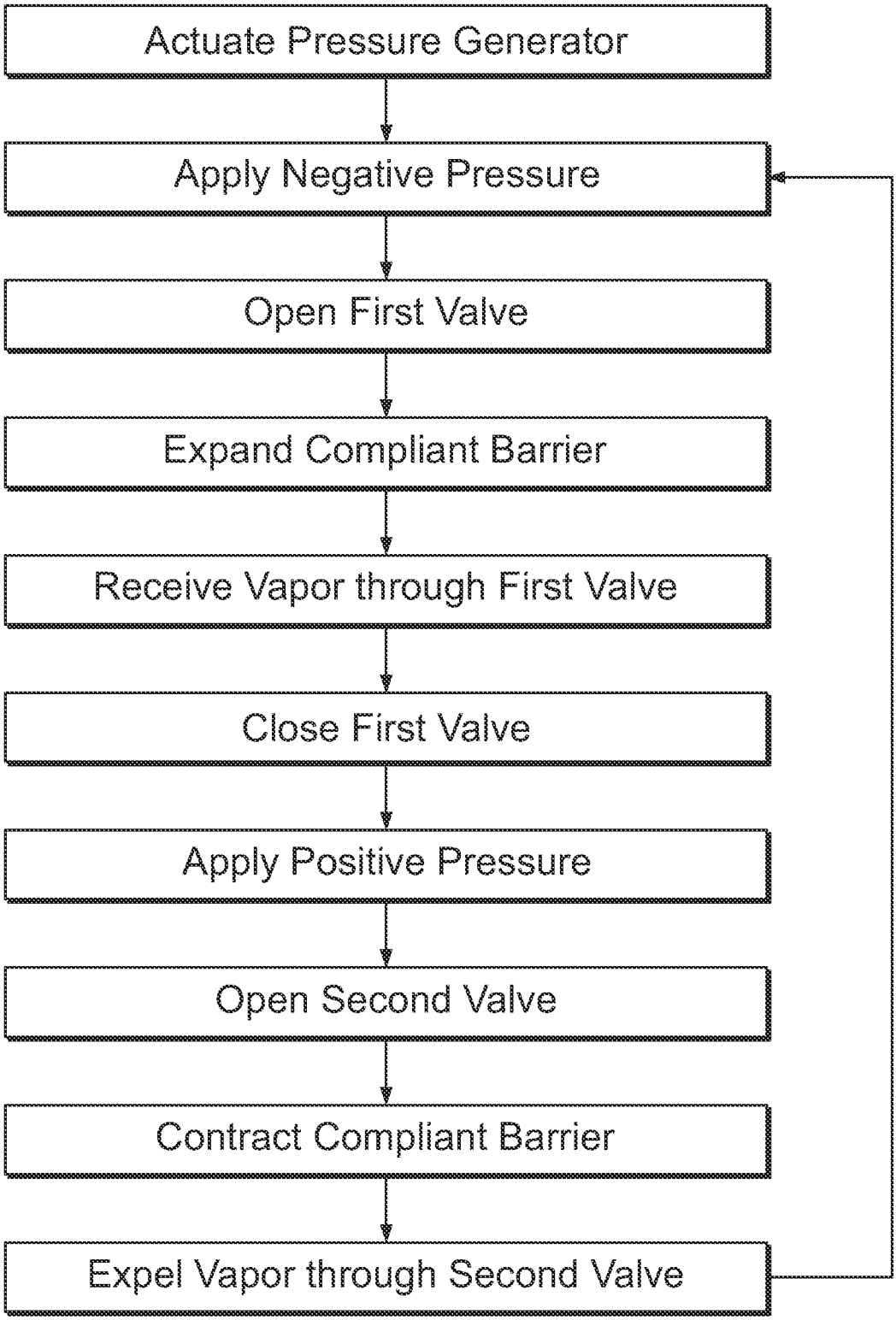
FIG. 9 is a flowchart for a process of the inhalation exposure system from any of the embodiments of FIGS. 1A-G, 2A-C, and 3A-C.

Referring to FIG. 9, the process of using the inhalation exposure system 100, as described herein, is depicted. First a differential pressure generator can be actuated, such as the piston 126 and/or the pump 124 (refer to FIGS. 4A-D, 5, 6A-B). As described throughout, the pressure generator can be actuated manually by a user and/or automatically by the user device 310 (refer to FIGS. 1A, 8A-B). Once actuated, negative pressure can be applied such that a first valve (e.g., input/inhale valve) is opened (refer to FIGS. 4A-D). Once opened, the negative pressure can force the barrier 106 to expand, as described herein. The barrier can receive a vapor through the first valve. Upon receiving the vapor, the first valve can close and then the pressure generator can apply positive pressure. Applying the positive pressure forces a second valve (e.g., output/exhale valve) to open, thereby causing the compliant barrier to contract and expel the vapor through the second valve (refer to FIGS. 4A-D). The process depicted in FIG. 9 can be repeated continuously and/or for however long the user desires. For example, referring to FIGS. 8A and 9, if the user at the user device 310 modifies the puff properties of smoke station 1 to puff a cigarette for 20 puffs, the inhalation exposure system 100 can repeat the steps in FIG. 9 until 20 puffs are completed. Thus, one puff would be equivalent to one iteration of the process depicted in FIG. 9.

Figure 10:
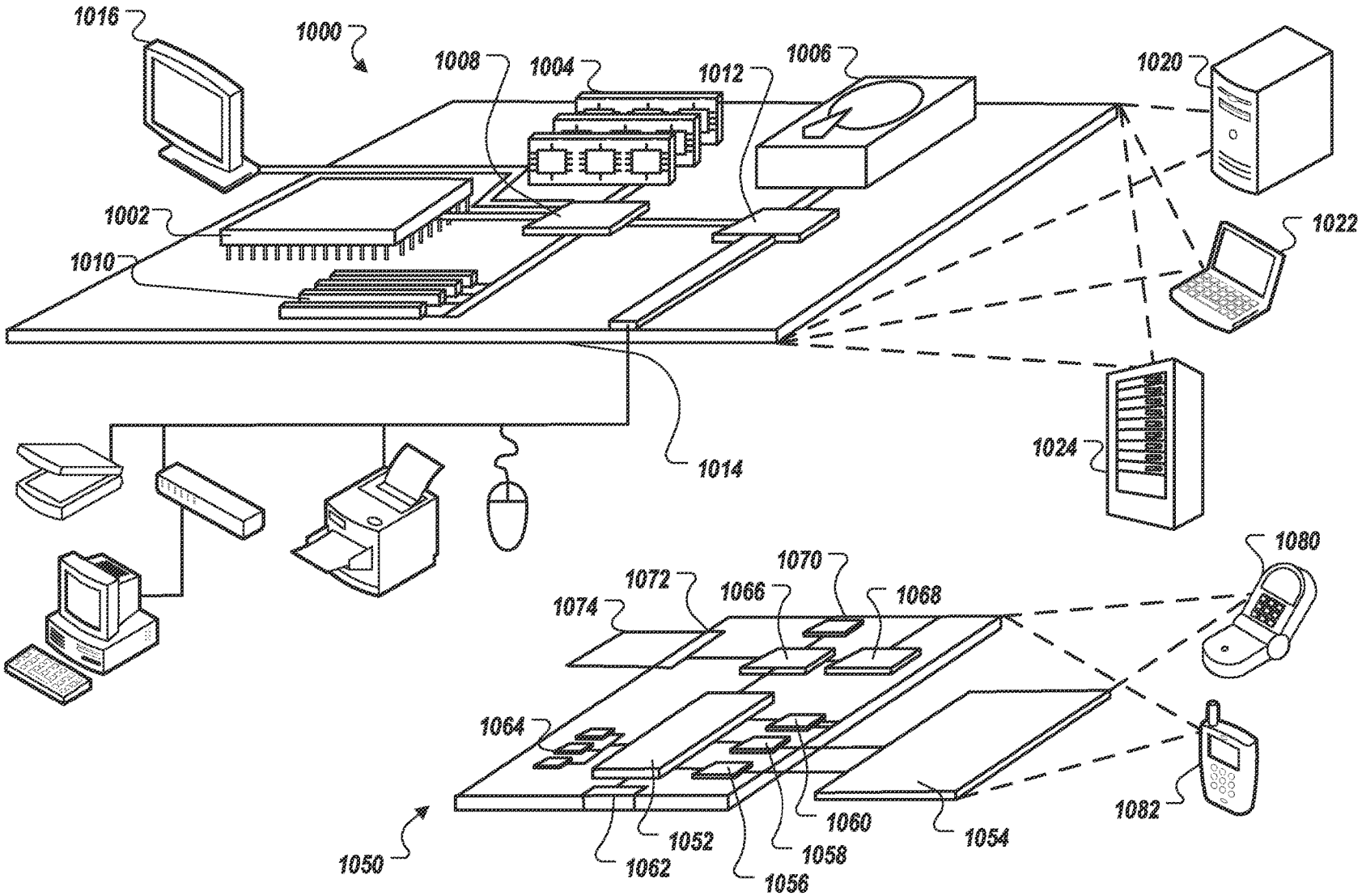
FIG. 10 is a block diagram of computing devices that may be used to implement the systems and methods described in this document.

FIG. 10 is a block diagram of computing devices 1000, 1050 that may be used to implement the systems and methods described in this document (including in any of the embodiments of FIGS. 1A-G, 2A-C, and 3A-C). For example, the inhalation exposure system 100 can include the components of the computing device 1000. Additionally or alternatively, the inhalation exposure system 100 can be in communication (e.g., wired, by a USB 312, for example, and/or wireless) with the user device 310, which can be implemented to include the components of the computing device 1000 or computing device 1050, and the user device 310 can be operated as either a client device or as a server or plurality of servers.

Computing device 1000 is intended to represent various forms of digital computers, such as laptops, desktops, workstations, personal digital assistants, servers, blade servers, mainframes, and other appropriate computers. Computing device 1050 is intended to represent various forms of mobile devices, such as personal digital assistants, cellular telephones, smartphones, and other similar computing devices. Additionally computing device 1000 or 1050 can include Universal Serial Bus (USB) flash drives. The USB flash drives may store operating systems and other applications. The USB flash drives can include input/output components, such as a wireless transmitter or USB connector that may be inserted into a USB port of another computing device. The components shown here, their connections and relationships, and their functions, are meant to be exemplary only, and are not meant to limit implementations of the inventions described and/or claimed in this document.

Computing device 1000 includes a processor 1002, memory 1004, a storage device 1006, a high speed interface 1008 connecting to memory 1004 and high speed expansion ports 1010, and a low speed interface 1012 connecting to low speed bus 1014 and storage device 1006. Each of the components 10002, 1004, 1006, 1008, 1010, and 1012, are interconnected using various busses, and may be mounted on a common motherboard or in other manners as appropriate. The processor 1002 can process instructions for execution within the computing device 1000, including instructions stored in the memory 1004 or on the storage device 1006 to display graphical information for a GUI on an external input/output device, such as display 1016 coupled to high speed interface 1008. In other implementations, multiple processors and/or multiple buses may be used, as appropriate, along with multiple memories and types of memory. Also, multiple computing devices 1000 may be connected, with each device providing portions of the necessary operations (e.g., as a server bank, a group of blade servers, or a multi-processor system).

The memory 1004 stores information within the computing device 1000. In one implementation, the memory 1004 is a volatile memory unit or units. In another implementation, the memory 1004 is a non-volatile memory unit or units. The memory 1004 may also be another form of computer-readable medium, such as a magnetic or optical disk.

The storage device 1006 is capable of providing mass storage for the computing device 400. In one implementation, the storage device 1006 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 1004, the storage device 1006, or memory on processor 1002.

The high speed controller 1008 manages bandwidth-intensive operations for the computing device 1000, while the low speed controller 1012 manages lower bandwidth-intensive operations. Such allocation of functions is exemplary only. In one implementation, the high speed controller 1008 is coupled to memory 1004, display 1016 (e.g., through a graphics processor or accelerator), and to high speed expansion ports 1010, which may accept various expansion cards (not shown). In the implementation, low speed controller 1012 is coupled to storage device 1006 and low speed expansion port 414. The low speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 1000 may be implemented in a number of different forms, as shown in the figure. For example, it may be implemented as a standard server 1020, or multiple times in a group of such servers. It may also be implemented as part of a rack server system 1024. In addition, it may be implemented in a personal computer such as a laptop computer 1022. Alternatively, components from computing device 1000 may be combined with other components in a mobile device (not shown), such as device 1050. Each of such devices may contain one or more of computing device 1000, 1050, and an entire system may be made up of multiple computing devices 1000, 1050 communicating with each other.

Computing device 1050 includes a processor 1052, memory 1064, an input/output device such as a display 1054, a communication interface 1066, and a transceiver 1068, among other components. The device 450 may also be provided with a storage device, such as a microdrive or other device, to provide additional storage. Each of the components 1050, 1052, 1064, 1054, 1066, and 1068, are interconnected using various buses, and several of the components may be mounted on a common motherboard or in other manners as appropriate.

The processor 1052 can execute instructions within the computing device 1050, including instructions stored in the memory 1064. The processor may be implemented as a chip set of chips that include separate and multiple analog and digital processors. Additionally, the processor may be implemented using any of a number of architectures. For example, the processor 1002 may be a CISC (Complex Instruction Set Computers) processor, a RISC (Reduced Instruction Set Computer) processor, or a MISC (Minimal Instruction Set Computer) processor. The processor may provide, for example, for coordination of the other components of the device 1050, such as control of user interfaces, applications run by device 1050, and wireless communication by device 1050.

Processor 1052 may communicate with a user through control interface 1058 and display interface 1056 coupled to a display 1054. The display 1054 may be, for example, a TFT (Thin-Film-Transistor Liquid Crystal Display) display or an OLED (Organic Light Emitting Diode) display, or other appropriate display technology. The display interface 1056 may comprise appropriate circuitry for driving the display 1054 to present graphical and other information to a user. The control interface 1058 may receive commands from a user and convert them for submission to the processor 1052. In addition, an external interface 1062 may be provide in communication with processor 452, so as to enable near area communication of device 1050 with other devices. External interface 1062 may provide, for example, for wired communication in some implementations, or for wireless communication in other implementations, and multiple interfaces may also be used.

The memory 1064 stores information within the computing device 1050. The memory 1064 can be implemented as one or more of a computer-readable medium or media, a volatile memory unit or units, or a non-volatile memory unit or units. Expansion memory 1074 may also be provided and connected to device 1050 through expansion interface 1072, which may include, for example, a SIMM (Single In Line Memory Module) card interface. Such expansion memory 1074 may provide extra storage space for device 1050, or may also store applications or other information for device 1050. Specifically, expansion memory 1074 may include instructions to carry out or supplement the processes described above, and may include secure information also. Thus, for example, expansion memory 1074 may be provide as a security module for device 1050, and may be programmed with instructions that permit secure use of device 1050. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 1064, expansion memory 1074, or memory on processor 1052 that may be received, for example, over transceiver 1068 or external interface 1062.

Device 1050 may communicate wirelessly through communication interface 1066, which may include digital signal processing circuitry where necessary. Communication interface 1066 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 1068. In addition, short-range communication may occur, such as using a Bluetooth, WiFi, or other such transceiver (not shown). In addition, GPS (Global Positioning System) receiver module 1070 may provide additional navigation- and location-related wireless data to device 1050, which may be used as appropriate by applications running on device 1050.

Device 1050 may also communicate audibly using audio codec 1060, which may receive spoken information from a user and convert it to usable digital information. Audio codec 1060 may likewise generate audible sound for a user, such as through a speaker, e.g., in a handset of device 1050. Such sound may include sound from voice telephone calls, may include recorded sound (e.g., voice messages, music files, etc.) and may also include sound generated by applications operating on device 1050.

The computing device 1050 may be implemented in a number of different forms, as shown in the figure. For example, it may be implemented as a cellular telephone 1080. It may also be implemented as part of a smartphone 1082, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), peer-to-peer networks (having ad-hoc or static members), grid computing infrastructures, and the Internet.

The computing system can include clients and servers. A client and server are generally remote from each other and typically interact through a communication network. The relationship of client and server arises by virtue of computer programs running on the respective computers and having a client-server relationship to each other.

What is claimed is:

1. A system for generating vapor samples from at least one smoking article, comprising:

a mount having at least one smoking article port configured to receive at least one smoking article;

a rigid reservoir and a compliant barrier mounted in the rigid reservoir, wherein the rigid reservoir has a first valve and a second valve and is coupled to the mount so that the smoking article port is in fluid communication with a first interior space of rigid reservoir on a smoke exposure side of the compliant barrier; and a pressure generator in fluid communication with a second interior space of the rigid reservoir on a second side of the compliant barrier opposite of the smoke exposure side so as to apply a positive or negative pressure within the second interior space of the rigid reservoir on the second side of the compliant barrier, wherein the pressure generator is configured to apply negative pressure within the second interior space that urges the compliant barrier to deflect toward the second interior space and receive, along the smoke exposure side of the compliant barrier, a smoking article vapor from the at least one smoking article.

2. The system of claim 1, wherein the at least one smoking article port is in fluid communication with the first interior space of the rigid reservoir along the smoke exposure side of the compliant barrier via a first flow path that includes the first valve.

3. The system of claim 1, wherein the pressure generator is further configured to apply positive pressure to the compliant barrier that urges the compliant barrier to deflect toward the first interior space and expel the smoking article vapor via a second flow path that includes the second valve.

4. The system of claim 3, further comprising a test chamber in fluid communication with the second flow path extending from the second valve and configured to receive the smoking article vapor expelled from the first interior space along the smoke exposure side of the compliant barrier.

5. The system of claim 1, wherein the rigid reservoir comprises a plurality of compliant barriers removably mounted within the rigid reservoir.

6. The system of claim 1, wherein the compliant barrier is removably mounted within the rigid reservoir.

7. The system of claim 6, further comprising a second compliant barrier for replacement of said compliant barrier removably mounted within the rigid reservoir.

8. The system of claim 1, wherein the pressure generator comprises at least one of a piston attached to a linear actuator and a pump.

9. The system of claim 1, wherein the compliant barrier comprises at least one of a fluid barrier, a diaphragm, a sack, and a bellow.

10. The system of claim 9, wherein the compliant barrier comprises at least one of a concentric convoluted bellow, spiral convoluted bellow, and origami bellow.

11. The system of claim 1, wherein the at least one smoking article port is configured to receive at least one smoking article that comprises an electronic cigarette or a cigarette.

12. A method for transferring a smoking article vapor through an inhalation exposure system, the method comprising:

applying, using a pressure generator, negative pressure to a compliant barrier mounted within a rigid reservoir of the inhalation exposure system so that the compliant barrier is deflected;

responsive to the compliant barrier being deflected, receiving, along on a smoke exposure side of the compliant barrier, the smoking article vapor from a first flow path extending from at least one smoking article port having a smoking article mounted therein; and after receiving said smoking article vapor along on the smoke exposure side of the compliant barrier, oppositely deflecting the compliant barrier so that the smoking article vapor along on the smoke exposure side of the compliant barrier is at least partially expelled away from the rigid reservoir through a second flow path that is different from the first flow path.

13. The method of claim 12, wherein oppositely deflecting the compliant barrier comprises applying, using the pressure generator, positive pressure to a first side of the compliant barrier to which the negative pressure was previously applied.

14. The method of claim 12, further comprising expelling the smoking article vapor through the second flow path via an output valve.

15. The method of claim 12, further comprising expelling the smoking article vapor into a test chamber in fluid communication with the second flow path.

16. The method of claim 12, further comprising applying said negative pressure to a plurality of compliant barriers removably mounted within the rigid reservoir.

17. The method of claim 12, wherein the compliant barrier is removably mounted within the rigid reservoir.

18. The method of claim 17, further comprising:

removing the compliant barrier removably mounted within the rigid reservoir; and replacing said compliant barrier with a second compliant barrier.

19. The method of claim 12, further comprising, receiving, at the at least one smoking article port, at least one of an electronic cigarette or a cigarette.

20. The method of claim 12, further comprising mounting at least one compliant barrier within the rigid reservoir that comprises at least one of a fluid barrier, a diaphragm, a sack, and a bellow.

* * * * *